US006355404B1

(12) United States Patent
Camp et al.

(10) Patent No.: US 6,355,404 B1
(45) Date of Patent: Mar. 12, 2002

(54) POLYESTER BASE DISPLAY MATERIAL WITH TONE ENHANCING LAYER

(75) Inventors: Alphonse D. Camp, Rochester; Peter T. Aylward, Hilton; Robert P. Bourdelais, Pittsford; Thomas M. Laney, Hilton; John L. Pawlak, Rochester; Gary J. McSweeney, Hilton, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/731,358

(22) Filed: Dec. 6, 2000

(51) Int. Cl.[7] ..... G03C 1/46; G03C 1/825; G03C 1/93; G03C 1/795

(52) U.S. Cl. ..... 430/432; 430/434; 430/502; 430/507; 430/510; 430/527; 430/533; 430/534

(58) Field of Search ..... 430/502, 507, 430/533, 534, 510, 527, 432, 434

(56) References Cited

U.S. PATENT DOCUMENTS

| | | | | | |
|---|---|---|---|---|---|
| 2,887,379 | A | * | 5/1959 | Blake et al. | 430/502 |
| 5,314,861 | A | | 5/1994 | Morohoshi et al. | 503/227 |
| 5,387,501 | A | | 2/1995 | Yajima et al. | 430/533 |
| 5,389,422 | A | | 2/1995 | Okazaki et al. | 428/141 |
| 5,466,519 | A | | 11/1995 | Shirakura et al. | 430/538 |
| 5,866,282 | A | | 2/1999 | Bourdelais et al. | 430/536 |
| 6,017,685 | A | | 1/2000 | Bourdelais et al. | 430/502 |
| 6,030,756 | A | | 2/2000 | Bourdelais et al. | 430/533 |
| 6,074,788 | A | | 6/2000 | Bourdelais et al. | 430/18 |
| 6,083,669 | A | * | 7/2000 | Bourdelais et al. | 430/533 |
| 6,093,521 | A | | 7/2000 | Laney et al. | 430/502 |
| 6,162,549 | A | | 12/2000 | Camp et al. | 503/227 |
| 6,258,494 | B1 | * | 7/2001 | Bourdelais et al. | 430/502 |

FOREIGN PATENT DOCUMENTS

| | | |
|---|---|---|
| WO | WO 94/04961 | 3/1994 |

* cited by examiner

*Primary Examiner*—Richard L. Schilling
(74) *Attorney, Agent, or Firm*—Paul A. Leipold

(57) ABSTRACT

The invention relates to a display material comprising a base, said base comprising a polyester sheet comprising at least one voided polyester diffusion layer, at least one topside photosensitive silver halide layer on the topside of said base and at least one bottom side photosensitive layer on the bottom side of said base, below said at least one bottom side emulsion layer a tone enhancing layer, and below said tone enhancing layer an antihalation layer, wherein said display material has a light transmission of between 35 and 60 percent in the developed Dmin areas of the display material.

46 Claims, 3 Drawing Sheets

POLYESTER BASE DISPLAY MATERIAL WITH TONE ENHANCING LAYER

FIELD OF THE INVENTION

This invention relates to photographic materials. In a preferred form it relates to base materials for photographic reflection and transmission display.

BACKGROUND OF THE INVENTION

It is known in the art that photographic display materials are utilized for advertising, as well as decorative displays of photographic images. Since these display materials are used in advertising, the image quality of the display material is critical in expressing the quality message of the product or service being advertised. Further, a photographic display image needs to be high impact, as it attempts to draw consumer attention to the display material and the desired message being conveyed. Typical applications for display material include product and service advertising in public places such as airports, buses and sports stadiums, movie posters, and fine art photography. The desired attributes of a quality, high impact photographic display material are a slight blue density minimum, durability, sharpness, and flatness. Cost is also important, as display materials tend to be expensive compared with alternative display material technology such as lithographic images on paper. For display materials, traditional color paper is undesirable, as it suffers from a lack of durability for the handling, photo processing, and display of large format images.

Prior art photographic display materials historically have been classified as either reflection or transmission. Reflection display material typically is highly pigmented image supports with a light sensitive silver halide coating applied. Reflection display materials are typically used in commercial applications where an image is used to convey an idea or message. An application example of a reflection display material is product advertisement in a public area. Prior art reflection display materials have been optimized to provide a pleasing image using reflective light. Transmission display materials are used in commercial imaging applications and are typically backlit with a light source. Transmission display materials are typically a clear support with a light sensitive silver halide and an incorporated diffuser (to hide the "show through" of the lamps used to provide viewing illumination) or a substantially transparent support coated with a light sensitive silver halide emulsion which requires a diffusing screen to be placed behind the material as a means to obscure the "show through" of the lamps used to provide illumination to the media. Prior art transmission display materials have been optimized to provide a pleasing image when the image is backlit with a variety of light sources. Because prior art reflection and transmission products have been optimized to be either a reflection display image or a transmission display image, two separate product designs must exist in manufacturing, and two inventories of display materials must be maintained at the photofinishing printing site. Further, when the quality of the backlighting for transmission display material is diminished when, for example, a backlight burns out or the output of the backlight decreases with the age, the transmission image will appear dark and reduce the commercial value of the image. It would be desirable if an image support could function both as a reflection and transmission display material.

Prior art transmission display materials use a high coverage of light sensitive silver halide emulsion to increase the density of the image compared to photographic reflection print materials. While increasing the coverage does increase the density of the image in transmission space, the time to image development is also increased as the coverage increases. Typically, a high-density transmission display material has a developer time of at least 110 seconds compared to a developer time of 45 seconds or less for photographic print materials. Prior art high-density transmission display materials, when processed, reduce the productivity of the development lab. Further, coating a high coverage of emulsion requires additional drying of the emulsion in manufacturing, which reduces the productivity of emulsion coating machines. It would be desirable if a transmission display material was high in density and had a developer time less than 50 seconds.

Prior art reflection photographic materials with a polyester base use a $TiO_2$ pigmented polyester base onto which light sensitive silver halide emulsions are coated. It has been proposed in WO 94/04961 to use opaque polyester containing 10% to 25% $TiO_2$ for a photographic support. The $TiO_2$ in the polyester gives the reflection display materials an undesirable opalescent appearance. The $TiO_2$ pigmented polyester also is expensive because the $TiO_2$ must be dispersed into the entire thickness, typically from 100 to 180 $\mu$m. The $TiO_2$ used in this fashion also gives the polyester support a slight yellow tint, which is undesirable for a photographic display material. For use as a photographic display material, the polyester support containing $TiO_2$ must be tinted blue to offset the yellow tint of the polyester, causing a loss in desirable whiteness and adding cost to the display material.

Prior art photographic display material uses polyester as a base for the support. Typically the polyester support is from 150 to 250 $\mu$m thick to provide the required stiffness. Prior art photographic display materials are typically coated with light sensitive silver halide imaging layers on one side of the support. Exposure devices have been built to expose only one side of prior art display materials, thus there is little concern for print platen design. For example, exposure devices that use a vacuum roll for holding the media during exposing typically employ slots for vacuum. These slots act as "black traps" (areas where exposing energy will be lost and have little secondary reflection) which in a duplitized emulsion system will result in uneven density for the backside image.

In U.S. Pat. No. 6,030,756 duplitized silver halide imaging layers are discussed for use as a display material. In U.S. Pat. No. 6,030,756, both the top and bottom images are exposed by exposing the topside silver halide imaging layers. While the display material in U.S. Pat. No. 6,030,756 does form an excellent image capable of an exceptional reflection and transmission image, the display material in U.S. Pat. No. 6,030,756 does suffer from uneven backside image density when placed against a non-uniform reflecting platen and subsequently exposed with light energy.

It has been found that the prior art structure disclosed in U.S Pat. Nos. 6,030,756 and 6,017,685 is plagued with uneven density variations as a result of uncontrolled backscatter in certain printers in the absence of an antihalation layer. As is obvious, this undesirable exposure can be effectively controlled by the addition of an antihalation layer. However, the presence of an antihalation layer was found to give greatly diminished imaging efficiency, particularly in the backside imaging layer. In this case, the curve shape of an exposure versus density plot reveals a significant break at the mid-scale that leads to significantly lower shoulder and maximum density, as compared to an element without the antihalation layer. Although in principle it may be possible to recover this density with the addition of silver and coupler to the backside imaging layers, this would be very undesirable on a material cost basis and also due to the desire to keep the required photo processing time to a minimum.

PROBLEM TO BE SOLVED BY THE INVENTION

There is a continuing need for an improved product that will present a bright reflective image when viewed directly and also provide a sharp bright image of sufficient dye density when back illuminated.

SUMMARY OF THE INVENTION

It is an object of the invention to overcome disadvantages of display materials.

It is another object to provide a superior, lower cost, and stronger display material.

It is another object to provide a backside image of sufficient dye density when the only exposing light is on the front side of the display element.

These and other objects of the invention are accomplished by a display material comprising a base, said base comprising a polyester sheet comprising at least one voided polyester diffusion layer, at least one topside photosensitive silver halide layer on the topside of said base and at least one bottom side photosensitive layer on the bottom side of said base, below said at least one bottom side emulsion layer a tone enhancing layer, and below said tone enhancing layer an antihalation layer, wherein said display material has a light transmission of between 35 and 60 percent in the developed Dmin areas of the display material.

ADVANTAGEOUS EFFECT OF THE INVENTION

The invention provides a material that will, when imaged and developed, result in a bright sharp reflective image when viewed in ambient front surface lighting conditions, as well as allowing for a pleasing image of sufficient dye density when illuminated with a transmission light source. In a preferred form the invention provides a product that may be provided with a silver halide image on each side but still retain a single exposure step and short processing time.

DETAILED DESCRIPTION OF THE INVENTION

Figure 1:
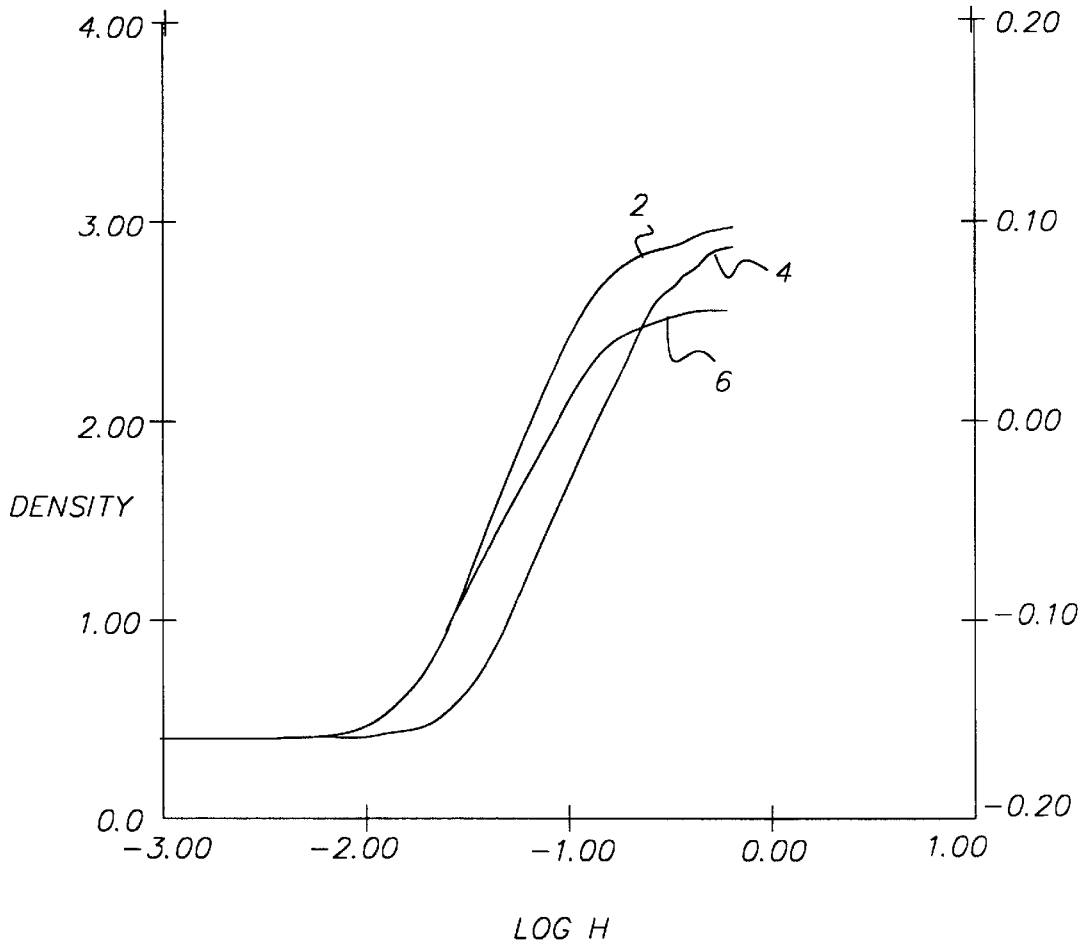
FIG. 1 is a plot of density vs. exposure that demonstrates the duplitized coating method and resulting sensitometry.

The invention has numerous advantages over prior display materials and methods of imaging display materials. The display materials of the invention provide very efficient diffusing of light while allowing the transmission of a high percentage of the light. The layers of the coextruded polyester sheet of this invention have levels of voiding, optical brightener, and colorants adjusted to provide optimum transmission and reflection properties. The polyester sheet has a voided layer to efficiently diffuse the illuminating light source common with transmission display materials without the use of expensive $TiO_2$ or other white pigments.

The voided, oriented polyester sheet of this invention is also low in cost, as the functional layer is coextruded at the same time, avoiding the need for further processing such as lamination, priming, or extrusion coating. The materials are low in cost as the coextruded microvoided polymer material sheet is made in one step. Prior art products are typically a two step process or incorporate a bottom pigmented layer coating which adds to the drying load and slow the coating process down. The formation of transmission display materials requires a display material that diffuses light so well that individual elements of the illuminating bulbs utilized are not visible to the observer of the displayed image. On the other hand, it is necessary that light be transmitted efficiently to brightly illuminate the display image. The invention allows a greater amount of illuminating light to actually be utilized as display illumination while at the same time very effectively diffusing the light sources such that they are not apparent to the observer. The display material of the invention will appear whiter to the observer than prior art materials which have a tendency to appear somewhat yellow as they require a high amount of light scattering pigments to prevent the viewing of individual light sources. These high concentrations of pigments appear yellow to the observer and result in an image that is darker than desirable.

The material as it contains in its preferred form silver halide imaging layers on both sides of a polymer sheet may be imaged by a collimated beam exposure device in a single exposure. As there are two relatively thin layers of silver halide image materials, the developing of the invention element may be carried out rapidly as the penetration of the developing solution is rapid through the thin layers of imaging material, allowing greater productivity in a commercial printing lab. The material of the invention is robust to exposure devices, as the materials added to the bottommost layers allows for different exposure devices to be utilized for the formation of quality images. The invention material allows for the simultaneous exposure of both the top and bottom imaging layers while preventing the effect of printer backscatter which would significantly degrade the quality of the image. The structure of the media allows for a pleasing reflection image when the image is captured in a light box containing an air gap from the illumination lamps used for transmission viewing, while also providing uniform diffusion of the transmission illumination source to provide a pleasing transmission image.

The invention materials ensure that the speed of the front side and back side formed dye density after processing results in a differential speed of the two such that when measured by Status A transmission densitometry, there is presented a continuous and uninterrupted curve shape substantially free from non-uniformities caused by an incorrect speed offset of the front side and back side emulsions. A thinner base material would be lower in cost and allow for roll handling efficiency as the rolls would weigh less and be smaller in diameter. It would be desirable to use a base material that had the required stiffness but was thinner to reduce cost and improve roll-handling efficiency. These and other advantages will be apparent from the detailed description below.

Duplitized display materials possessing both reflection properties as well as sufficient dye formed on the back side as a means to present pleasing densities when backlit would be highly desired for display applications. The media would present eye-catching and aesthetically pleasing reflection images, as well as being able to provide pleasing images of sufficient dye densities during nighttime or in low ambient light levels when illuminated from the backside. In addition, the dual property of the formed image (both reflection and transmissive) would allow for pleasing images in outdoor applications or those cases subject to non-controllable high ambient reflection surface lighting (man-made or natural) by the property of the formed front side image. By this invention, the face side image formed and backed by the semi-reflective property of the substrate and illuminated by front surface lighting would not appear "blocked in" as conventional transmission only display media would. However, the same attributes that provide a multi purpose media for viewing have been found to present some difficulties in forming said images. The inability to predict the future with regard to printer design and expected wear of existing printers can cause serious deficiencies in correct latent image formation. Specifically, a backside light sensitive layer, when exposed against a backing platen of non-uniform reflectivity (due to either wear or design), can adversely affect both the quality of the formed backside latent image, as well as the subsequently processed image resulting in localized non-uniform dye density. The obvious use of an antihalation layer below and adjacent to the bottommost light sensitive layer in the backside structure would clearly resolve the problem of non-uniform reflectivity of any backing apparatus in the printer, but presents its own set of issues. This inclusion of an antihalation layer will solve the problem of backlight scatter by non-uniform reflectivity of media backing in the printer but will also remove the benefit of any secondary exposure of the backside light sensitive layers.

For this invention, both a "primary first exposure" and an automatic "secondary exposure" of the backside emulsion occurs when exposed from only the front side. This is caused by the designed backscatter of the media and compensates for the initial loss of the imaging radiation caused by imaging through the front side of the media and passing through both front side absorber dyes, as well as the turbid support prior to reaching the backside light sensitive layers. In this fashion, a mirror image of the front side image of sufficient sharpness and sufficient dye density is formed on the backside. This allows for both proper image registration (low to no flare of the backside image), as well as sufficient dye density to survive backlighting. In the presence of an antihalation layer on the backside necessitated by uncontrolled backscatter in the printer, the practical result will be a very low density formation of the backside image, and any attempt to increase the front side exposure to improve the backside density will result in overexposure of the face side light sensitive layers, thus degrading the front side image. This obstacle was solved by the invention whereby a tone enhancing layer was added to the backside adjacent to the bottommost light sensitive layer to provide a tunable "secondary exposure" capability, while also allowing for the application of an antihalation layer to defeat any non-uniform reflectivity resulting from any backing platen or stray backlight in the printer. It has been found that these problems can be solved by the addition of a tone enhancing layer between the bottommost light sensitive layer and an antihalation layer. This tone enhancing layer is comprised of gelatin and a component capable of reflecting light with minimal scatter. Suitable materials include, but are not limited to, titanium dioxide, barium sulfate, clay, calcium carbonate, or suitable polymeric materials. Suitable polymeric materials include hollow polystyrene beads such as Ropaque™ beads (HP-1055, Rohm & Haus). Most preferred is $TiO_2$, which may be either of the anatase or rutile type. $TiO_2$ is preferred, as it is low cost, effective, and not reactive with imaging materials.

The tone enhancing layer may be provided with any suitable amount of $TiO_2$ or other light reflecting material. A generally suitable amount is 0.25 to 10 g/m$^2$. A more suitable amount is between 0.75 and 5 g/m$^2$. A preferred amount for best tone enhancing and reasonable cost is between 1.0 and 2.5 g/m$^2$.

The use of this tone enhancing layer also allows for even further improvement of the backside image sharpness, as well as an overall and pleasing increase in transmission maximum density while not adversely affecting the quality the face side image.

In an alternate embodiment, it has been found that a tone enhancing layer beneath the bottommost light sensitive layer can be used without an antihalation layer to enable substantial silver savings, thus resulting in a lower cost product. In this manner, the tone enhancing layer reduces the amount of light lost through the pack and, therefore, the impact of any non-uniform back reflection from printer platens is reduced.

FIG. 1 is a plot of density on the vertical axis in units of Status A red/green/blue density and log exposure on the horizontal axis. FIG. 1 was generated by applying the duplitized silver halide coating to a voided polymer base with no antihalation layer and no tone enhancing layer and separation exposing on with a red, green, and blue laser, with a uniform black backing platen, and processed in conventional RA-4 chemistry and read on a Transmission X-Rite densitometer. The three curves are for the cyan 2, the magenta 4, and the yellow 6. FIG. 1 represents the performance of prior art duplitized silver halide display materials which results in reasonable transmission image quality. However, the materials in FIG. 1 are not robust to those printing devices that have non-uniform print platen reflectivity.

Figure 2:
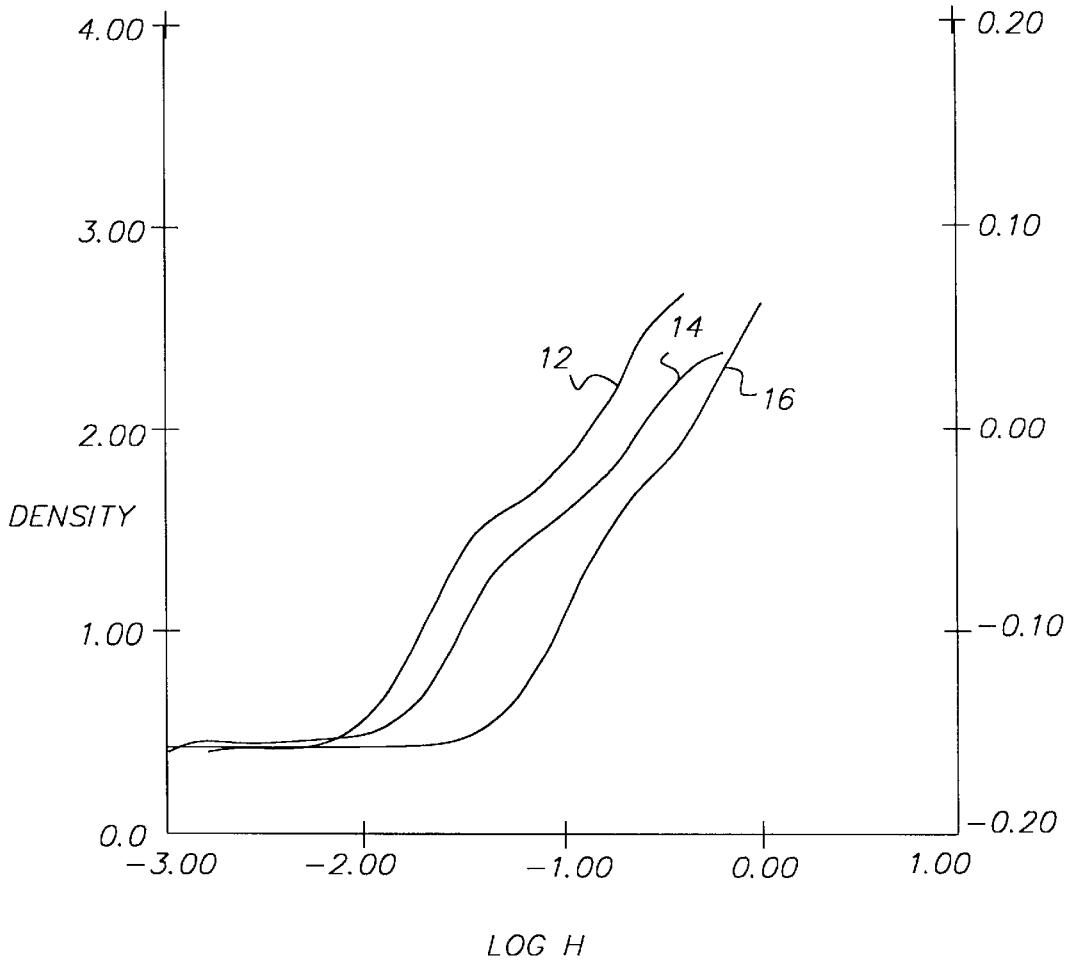
FIG. 2 is a plot of density vs. exposure that demonstrates the duplitized coating with the addition of the antihalation layer and the resulting poor tone scale obtained.

FIG. 2 is a plot of density on the vertical axis in units of Status A red/green/blue density and log exposure on the horizontal axis. FIG. 2 was generated by applying the duplitized silver halide coating to a voided polymer base with an antihalation layer and no tone enhancing layer and separation exposing on with a red, green, and blue laser, with a uniform black backing platen, and processed in conventional RA-4 chemistry and read on a Transmission X-Rite densitometer. The three curves are for the cyan 12, the magenta 14, and the yellow 16. FIG. 2 represents the prior art materials with the addition of an antihalation layer in the bottommost layer to ensure good image quality in those print devices that have non uniform print platen reflectivity. However, as illustrated in FIG. 2, the incorporation of the antihalation layer has adversely attenuated the bottom emulsion exposure such that insufficient backside density is formed. The antihalation layer did not only minimize printer backscatter, but also reduced backscatter internal to the structure resulting in a loss of back image density as evidenced by the break in the mid-scale of curves 12, 14, and 16. Samples prepared without the antihalation layer, but backed with black backing and exposed, did not suffer the same loss of backside density as those coated with the antihalation layer.

Figure 3:
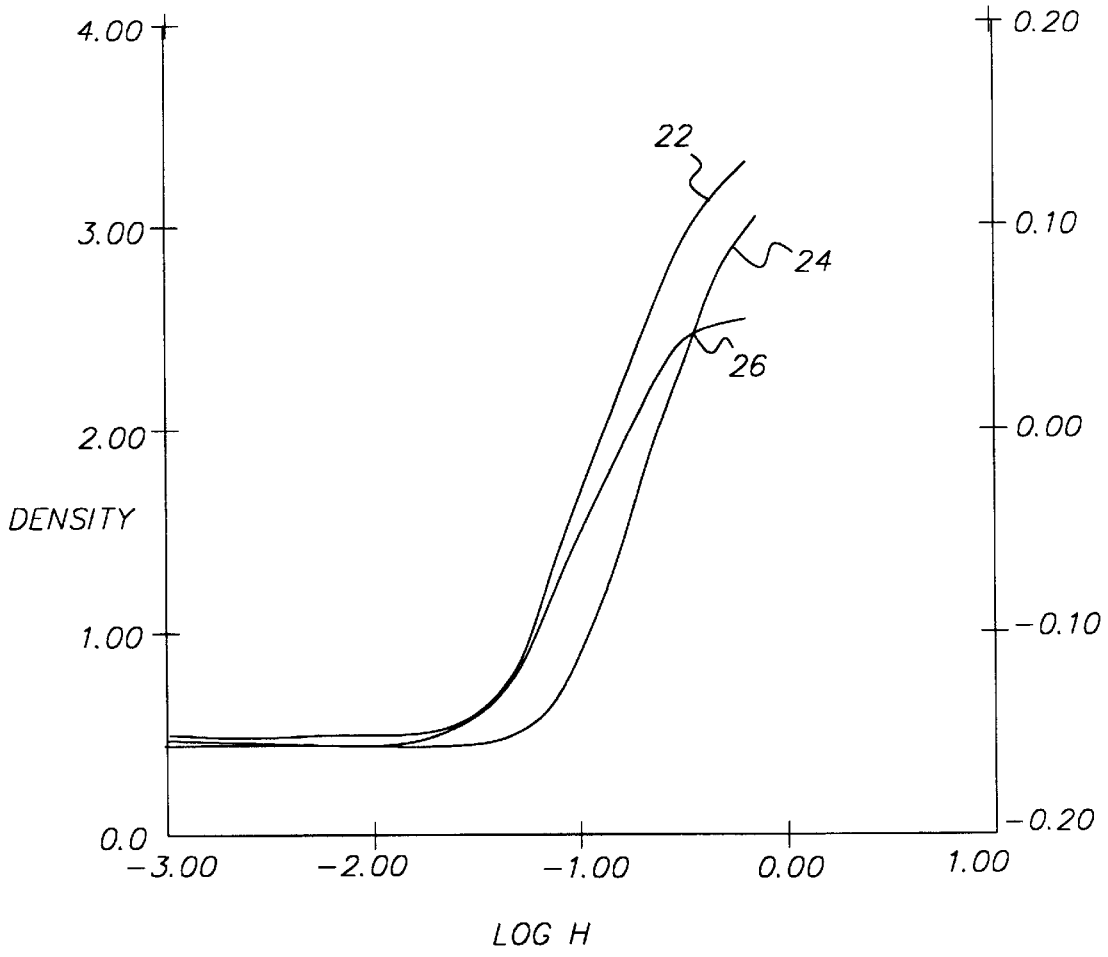
FIG. 3 is a plot of density vs. exposure that demonstrates the invention whereby the tone enhancing layer is added to the duplitized coating containing the antihalation layer and the resulting robust sensitometric position obtained.

FIG. 3 is a plot of density on the vertical axis in units of Status A red/green/blue density and log exposure on the horizontal axis. FIG. 3 was generated by applying the duplitized silver halide coating to the base of the invention with an antihalation layer and a tone enhancing layer and separation exposing on with a red, green and blue laser, with a uniform black backing platen, and processed in conventional RA-4 chemistry and read on a Transmission X-Rite densitometer. The three curves are for the cyan 22, the magenta 24, and the yellow 26. FIG. 3 represents the invention materials that utilize both an antihalation layer and a tone-enhancing layer of the invention. Surprisingly, not only did the tone enhancing layer of the invention return to the ability to produce sufficient backside density as shown in FIG. 1, but also improved backside density formation, thus resulting a high quality image that is insensitive to print platen reflectivity. Further, the invention material provides an overall higher maximum density position compared to prior art duplitized display materials, which results in better image quality.

Many types of photographic elements typically comprise some form of antihalation protection. Halation has been a persistent problem with photographic films comprising one or more photosensitive silver halide emulsion layers coated on a transparent support. The emulsion layer diffusely transmits light, which then reflects back into the emulsion layer from the support surface. The silver halide emulsion is thereby re-exposed at locations different from the original light path through the emulsion, resulting in "halos" on the film surrounding images of bright objects.

A variety of methods for antihalation protection have been proposed in the art, for example, the use of an antihalation hydrophilic colloid layer containing filter dyes or silver metal coated beneath the emulsion layers, wherein the filter dyes or silver is solubilized and removed during processing of the film without removal of the hydrophilic colloid layer itself. For hydrophilic colloid antihalation and filter layers coated on the same side of the support as light sensitive emulsion layers of a photographic element, filter dyes are typically incorporated into such layers as water soluble dyes, as conventional oil-in-water dispersions, as loaded polymeric latex dispersions, or as aqueous solid particle dispersions such as described in U.S. Pat. No. 5,657,931. Other methods for antihalation are described in section VIII of *Research Disclosure,* September 1994, Item 36544, Section I, published by Kenneth Mason Publications, Ltd., Dudley Annex, 12a North Street, Emsworth, Hampshire PO10 7DQ, ENGLAND.

The terms as used herein, "top", "upper", and "face" relate to the side that is facing the exposure source. The terms "bottom", "lower", and "back" mean the side that is farther from the exposure source. The term as used herein, "transparent" means the ability to pass radiation without significant deviation or absorption. For this invention, "transparent" material is defined as a material that has a spectral transmission greater than 90%. For a photographic element, spectral transmission is the ratio of the transmitted power to the incident power and is expressed as a percentage as follows: $T_{RGB}=10^{-D}*100$ where D is the average of the red, green and blue Status A transmission density response of the processed minimum density of the photographic element as measured by an X-Rite model 310 (or comparable) photographic transmission densitometer. The term as used herein, "duplitized" means light sensitive silver halide coating on the topside and the bottom side of the imaging support.

The layers of the coextruded biaxially oriented polyester sheet of this invention have levels of voiding, $TiO_2$ and colorants adjusted to provide optimum transmission properties. The biaxially oriented polyester sheet is coextruded as a multilayer base that has a transparent polymer base and a thin microvoided layer for efficient diffusing for illuminating light sources, enhanced image processing as well as product handling for display assembling. Further, it has been found that the process to void polyester yields smaller and better dispersed void structure compared to polyolefin voided layers and thus polyester tends to provide more efficient diffusion of illumination light energy. An important aspect of this invention is the imaging support is coated with a image receiving layer on the top side and the bottom side, this duplitized imaging receiving layer combined with the optical properties of the polyester base provides an improved display material that can be used in transmission and reflection.

In order to provide a preferred imaging element that can be used in transmission and reflection the preferred structure comprises an imaging member with an image receiving layer on the bottom of the element below a polymer sheet. The polymer sheet comprises at least one layer of voided polyester polymer and at least one layer comprising nonvoided polyester polymer. The imaging member has a percent transmission of between 35 and 60%, in the Dmin areas after development. The imaging member further comprises tints, and the nonvoided layer is at least twice as thick as the voided layer. This structure is preferred because it provides an optimized integral diffusing screen that is necessary in transmission and sufficient reflection properties to provide an acceptable reflection image.

The polyester sheet of this invention preferably has a coextruded integral image receiving adhesion layer. Beyond the transparent layer and the voided layer, a coextruded polyethylene layer can be used with corona discharge treatment as an adhesion layer for the image receiving layer, avoiding the need for a primer coating common with polyester sheets. A polyethylene layer with corona discharge treatment is preferred because gelatin based image receiving layers adhere well to polyethylene without the need for primer coatings. Further, the integral polyethylene skin layer may also contain blue tints and optical brightener to compensate for the native yellowness of the digital imaging receiving layers. Because the polyethylene skin layer can be difficult to adhere to polyester polymer, a tie layer that adheres the polyethylene skin to the polyester polymer may be required.

The coextruded polyester base of the invention contains a clear polyester layer to provide stiffness without corrupting the transmission of light. The thickness ratio between the voided layer and the clear layer is at least 1:2. Above a 1:2 ratio, the support would not allow sufficient illumination for a quality image, as the voided layer would be too thick to allow for illumination of the image.

Oriented, voided polyester sheets are preferred as voided polyester has been shown to provide excellent light diffusion properties. The orientation provides added strength to the multilayer structure that provides enhanced handling properties when displays are assembled. Microvoided oriented sheets are preferred because the voids provide opacity without the use of $TiO_2$. Microvoided layers are conveniently manufactured by coextrusion of the core and thin surface layers, followed by biaxial orientation. Voids are formed around void-initiating material contained in the wire layers.

The total thickness of the sheet can range from 76 to 256 micrometers, preferably from 80 to 150 micrometers. Below 80 micrometers, the microvoided sheets may not be thick enough to minimize any inherent handling and kinking problems when handling large sheets of this material. At thickness higher than 150 micrometers, little improvement in either surface smoothness or mechanical properties are seen, and so there is little justification for the further increase in cost for extra materials. In the case of the preferred photographic imaging member, the microvoided layer should have a thickness between 6–50 micrometers. Below 6 micrometers, the diffusing properties of the layer are minimized and above 50 the layer becomes more opaque and hinders the quality for backlite applications with image receiving layers coated on each side.

"Void" is used herein to mean devoid of added solid and liquid matter, although it is likely the "voids" contain gas. The void-initiating particles which remain in the finished packaging sheet core should be from 0.1 to 10 micrometers in diameter, preferably round in shape, to produce voids of the desired shape and size. The size of the void is also dependent on the degree of orientation in the machine and transverse directions. Ideally, the void would assume a shape which is defined by two opposed and edge contacting concave disks. In other words, the voids tend to have a lens-like or biconvex shape. The voids are oriented so that the two major dimensions are aligned with the machine and transverse directions of the sheet. The Z-direction axis is a minor dimension and is roughly the size of the cross diameter of the voiding particle. The voids generally tend to be closed cells, and thus there is virtually no path open from one side of the voided-core to the other side through which gas or liquid can traverse.

For the biaxially oriented layer on the top side towards the imaging layer, suitable classes of thermoplastic polymers for the biaxially oriented sheet and the core matrix-polymer of the preferred composite sheet comprise polyolefins. Suitable polyolefins include polypropylene, polyethylene, polymethylpentene, polystyrene, polybutylene and mixtures thereof. Polyolefin copolymers, including copolymers of propylene and ethylene with polymers such as hexene, butene, and octene are also useful. Polyethylene is preferred, as it is low in cost and good adhesion properties to the image receiving layer. The polyethylene layer may comprise at least one layer of said polymer base sheet and, in particular, it may comprise a layer on top of said voided polyester layer. Another means to enhance adhesion of the image receiving layer on a the polyester polymer surface is to apply a subbing layer. Typical subbing layer may contain materials known in the art to promote adhesion to polyester and furthermore allow gelatin to adhere to the sub layer.

Addenda may be added to the topmost skin layer to change the color of the imaging element. For photographic use, a white base with a slight bluish tinge is preferred. The addition of the slight bluish tinge may be accomplished by any process which is known in the art including the machine blending of color concentrate prior to extrusion and the melt extrusion of blue colorants that have been pre-blended at the desired blend ratio. Colored pigments that can resist extrusion temperatures greater than 320° C. are preferred as temperatures greater than 320° C. are necessary for coextrusion of the skin layer. Blue colorants used in this invention may be any colorant that does not have an adverse impact on the imaging element. Preferred blue colorants include Phthalocyanine blue pigments, Cromophtal blue pigments, Irgazin blue pigments, Irgalite organic blue pigments and pigment Blue 60.

A finding that a very thin coating (0.2 to 1.5 micrometers) on the surface immediately below the image receiving layer can be made by coextrusion and subsequent stretching in the width and length direction. It has been found that this layer is, by nature, extremely accurate in thickness and can be used to provide all the color corrections which are usually distributed throughout the thickness of the sheet between the image receiving layer and the polyester base. This topmost layer is so efficient that the total colorants needed to provide a correction are less than one-half the amount needed if the colorants are dispersed throughout thickness. Colorants are often the cause of spot defects due to clumps and poor dispersions. Spot defects, which decrease the commercial value of images, are improved with this invention because less colorant is used and high quality filtration to clean up the colored layer is much more feasible since the total volume of polymer with colorant is only typically 2 to 10 percent of the total polymer between the base paper and the photosensitive layer.

Addenda may be added to the biaxially oriented sheet of this invention so that when the biaxially oriented sheet is viewed by the intended audience, the imaging element emits light in the visible spectrum when exposed to ultraviolet radiation. Emission of light in the visible spectrum allows for the support to have a desired background color in the presence of ultraviolet energy. This is particularly useful when images are backlit with a light source that contains ultraviolet energy and may be used to optimize image quality for transmission display applications.

Addenda known in the art to emit visible light in the blue spectrum are preferred. Consumers generally prefer a slight blue tint to white defined as a negative b* compared to a white white defined as a b* within one b* unit of zero. b* is the measure of yellow/blue in CIE space. A positive b* indicates yellow while a negative b* indicates blue. The addition of addenda that emits in the blue spectrum allows for tinting the support without the addition of colorants which would decrease the whiteness of the image. The preferred emission is between 1 and 5 delta b* units. Delta b* is defined as the b* difference measured when a sample is illuminated ultraviolet light source and a light source without any significant ultraviolet energy. Delta b* is the preferred measure to determine the net effect of adding an optical brightener to the top biaxially oriented sheet of this invention. Emissions less than 1 b* unit can not be noticed by most customers therefore is it not cost effective to add optical brightener to the biaxially oriented sheet. An emission greater that 5 b* units would interfere with the color balance of the prints making the whites appear too blue for most consumers.

The preferred addenda of this invention is an optical brightener. An optical brightener is substantially colorless, fluorescent, organic compound that absorbs ultraviolet light and emits it as visible blue light. Examples include but are not limited to derivatives of 4,4'-diaminostilbene-2,2'-disulfonic acid, coumarin derivatives such as 4-methyl-7-diethylaminocoumarin, 1-4-Bis (O-Cyanostyryl) Benzol and 2-Amino-4-Methyl Phenol. An unexpected desirable feature of this invention is the efficient use of optical brightener. Because the ultraviolet source for a transmission display material is on the opposite side of the image, the ultraviolet light intensity is not reduced by ultraviolet filters common to imaging layers. The result is less optical brightener is required to achieve the desired background color.

The imaging element that comprises a polymer sheet with at least one voided polyester skin layer and at least one nonvoided polyester polymer layer should comprise a void space between about 2 and 60% by volume of said voided layer of said polymer sheet. Such a void concentration is desirable to optimize the transmission and reflective properties while providing adequate diffusing power to hide backlights and filaments.

The biaxially oriented coextruded polymer sheet may also contain white pigments which are known to improve the imaging responses such as whiteness or sharpness. Titanium dioxide is used in this invention to improve image sharpness. The $TiO_2$ used may be either anatase or rutile type. In the case of optical properties, rutile is the preferred because of the unique particle size and geometry. Further, both anatase and rutile $TiO_2$ may be blended to improve both whiteness and sharpness. Examples of $TiO_2$ that are acceptable for a imaging system are Dupont Chemical Co. R101 rutile $TiO_2$ and DuPont Chemical Co. R104 rutile $TiO_2$. Other pigments to improve imaging responses may also be used in this invention such as titanium dioxide, barium sulfate, clay, or calcium carbonate.

The preferred amount of $TiO_2$ added to the biaxially oriented sheet of this invention is between 4 and 18% by weight. Below 3% $TiO_2$, the required light transmission can not be easily achieved with microvoiding alone. Combining greater than 4% $TiO_2$ with voiding provides a biaxially oriented, micro voided sheet that is low in cost. Above 14% $TiO_2$, additional dye density from the photographic emulsions is required to overcome the loss in transmission.

The preferred spectral transmission for a day/night biaxially oriented coextruded polyester sheet of this invention is at between 38 to 55%. This range is preferred because it provides for optimal viewing with either backlighting or front viewing in daylight or room light conditions. Spectral transmission is the amount of light energy that is transmitted through a material. For an imaging element, spectral transmission is the ratio of the transmitted power to the incident power and is expressed as a percentage as follows; $T_{RGB}=10^{-D}*100$ where D is the average of the red, green and blue Status A transmission density response measured by an X-Rite model 310 (or comparable) photographic transmission densitometer. The higher the transmission, the less opaque the material. For a transmission display material with an incorporated diffuser, the quality of the image is related to the amount of light reflected from the image to the observers eye. A transmission display image with a low amount of spectral transmission does not allow sufficient illumination of the image causing a perceptual loss in image quality. A transmission image with a spectral transmission of less than 35% is unacceptable for a transmission display material as the quality of the image can not match prior art transmission display materials. Further, spectral transmissions less than 35% will require additional dye density from the photographic emulsions which increases the cost of the transmission display material. Spectral transmission greater than 38% provides preferred image quality. However as the spectral transmission becomes greater than 60%, it has been found that the materials does not sufficiently diffuse the backlighting illuminate and does not have the desired reflection properties to function as a reflection display material.

These coextruded sheets may be coated or treated after the coextrusion and orienting process or between casting and full orientation with any number of coatings which may be used to improve the properties of the sheets including printability, to provide a vapor barrier, or to improve the adhesion to the support or to the photo sensitive layers. Examples of this would be acrylic coatings for printability, coating polyvinylidene chloride for heat seal properties or barrier properties. Further examples include flame, plasma or corona discharge treatment to improve printability or adhesion. In addition it is also possible to provide either an integral layer or a separately coated layer of either an electrical conductive or charge control layer to minimize the generation of electrostatic glow or discharge of a photosensitive imaging member. The preferred embodiment is an imaging member comprising at least one photosensitive silver halide layer on the top of said member and at least one photosensitive silver halide layer on the bottom of said layer, a polymer sheet comprising at least one layer of voided polyester polymer and at least one layer comprising nonvoided polyester polymer, wherein the imaging member has a percent transmission of between 38 and 55%, the imaging member further comprises tints, and the nonvoided layer is at least twice as thick as the voided layer and the member further comprises at least one layer comprising a charge control and or having a electrical resistivity of less than $10^{11}$ ohms per square below the said polyethylene layer of the topmost part of the base member.

The polyester utilized in the invention should have a glass transition temperature between about 50° C. and about 150° C., preferably about 60–100° C., should be orientable, and have an intrinsic viscosity of at least 0.50, preferably 0.6 to 0.9. Suitable polyesters include those produced from aromatic, aliphatic, or cyclo-aliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexane-dicarboxylic, sodiosulfoiso-phthalic, and mixtures thereof. Examples of suitable glycols include ethylene glycol, propylene glycol, butanediol, pentanediol, hexanediol, 1,4-cyclohexanedimethanol, diethylene glycol, other polyethylene glycols and mixtures thereof Such polyesters are well known in the art and may be produced by well-known techniques, e.g., those described in U.S. Pat. No. 2,465,319 and 2,901,466. Preferred continuous matrix polymers are those having repeat units from terephthalic acid or naphthalene dicarboxylic acid and at least one glycol selected from ethylene glycol, 1,4-butanediol, and 1,4-cyclohexanedimethanol. Poly(ethylene terephthalate), which may be modified by small amounts of other monomers, is especially preferred. Polypropylene is also useful. Other suitable polyesters include liquid crystal copolyesters formed by the inclusion of a suitable amount of a co-acid component such as stilbene dicarboxylic acid. Examples of such liquid crystal copolyesters are those disclosed in U.S. Pat. Nos. 4,420,607; 4,459,402; and 4,468,510.

Voids in the ink-permeable upper polyester layer may be obtained by using microbeads during its fabrication. Such microbeads may be inorganic fillers or polymerizable organic materials. The particle size of the microbeads is preferably in the range of from about 0.1 to about 50 $\mu$m, more preferably from about 0.5 to about 5 $\mu$m, for best formation of an ink porous but smooth surface. The microbeads may be employed in an amount of 30–50% by volume in the feed stock for the ink-permeable upper polyester layer prior to extrusion and microvoiding. Typical inorganic materials for the microbeads include silica, alumina, calcium carbonate, and barium sulfate. Typical polymeric organic materials for the microbeads include polystyrenes, polyamides, fluoropolymers, poly(methyl methacrylate), poly(butyl acrylate), polycarbonates, or polyolefins.

The microbeads are at least partially bordered by voids. The void space in the supports should occupy 2–60%, preferably 30–50%, by volume of the film support. Depending on the manner in which the supports are made, the voids may completely encircle the microbeads, e.g., a void may be in the shape of a doughnut (or flattened doughnut) encircling a micro-bead, or the voids may only partially border the microbeads, e.g., a pair of voids may border a microbead on opposite sides.

During stretching the voids assume characteristic shapes from the balanced biaxial orientation of paperlike films to the uniaxial orientation of microvoided/satinlike fibers. Balanced microvoids are largely circular in the plane of orientation, while fiber microvoids are elongated in the direction of the fiber axis. The size of the microvoids and the ultimate physical properties depend upon the degree and balance of the orientation, temperature and rate of stretching, crystallization kinetics, the size distribution of the microbeads, and the like.

The film supports according to this invention are prepared by:

(a) forming a mixture of molten continuous matrixpolymer and microbeads wherein the microbeads are uniformly dispersed throughout the matrix polymer, the matrix polymer being as described hereinbefore, the microbeads being as described hereinbefore, (b) forming a film support from the mixture by co-extrusion or casting, (c) orienting the article by stretching to form microbeads uniformly distributed throughout the article and voids at least partially bordering the microbeads on sides thereof in the direction, or directions of orientation.

The mixture may be formed by forming a melt of the matrix polymer and mixing therein the microbeads Due to the incompatibility between the matrix polymer and microbeads there is no attraction or adhesion between them, and they become uniformly dispersed in the matrix polymer upon mixing.

When the microbeads have become uniformly dispersed in the matrix polymer, a film support is formed by processes such as coextrusion or co-casting. Examples of coextrusion or co-casting would be coextrusion or co-casting a film or sheet. Such forming methods are well known in the art. If sheets or film material are co-cast or coextruded, it is important that such article be oriented by stretching, at least in one direction. Methods of unilaterally or bilaterally orienting sheet or film material are well known in the art. Basically, such methods comprise stretching the sheet or film at least in the machine or longitudinal direction after it is co-cast or coextruded an amount of about 1.5–10 times its original dimension. Such sheet or film may also be stretched in the transverse or cross-machine direction by apparatus and methods well known in the art, in amounts of generally 1.5–10 (usually 3–4 for polyesters and 6–10 for polypropylene) times the original dimension. Such apparatus and methods are well known in the art and are described in such U.S. Pat. No. 3,903,234.

The voids, or void spaces, referred to herein surrounding the microbeads are formed as the continuous matrix polymer is stretched at a temperature above the Tg of the matrix polymer. The microbeads are relatively hard compared to the continuous matrix polymer. Also, due to the incompatibility and immiscibility between the microbead and the matrix polymer, the continuous matrix polymer slides over the microbeads as it is stretched, causing voids to be formed at the sides in the direction or directions of stretch, which voids elongate as the matrix polymer continues to be stretched. Thus, the final size and shape of the voids depends on the direction(s) and amount of stretching. If stretching is only in one direction, microvoids will form at the sides of the microbeads in the direction of stretching. If stretching is in two directions (bidirectional stretching), in effect such stretching has vector components extending radially from any given position to result in a doughnut-shaped void surrounding each microbead.

The preferred preform stretching operation simultaneously opens the microvoids and orients the matrix material. The final product properties depend on and can be controlled by stretching time-temperature relationships and on the type and degree of stretch. For maximum opacity and texture, the stretching is done just above the glass transition temperature of the matrix polymer. When stretching is done in the neighborhood of the higher glass transition temperature, both phases may stretch together and opacity decreases. In the former case, the materials are pulled apart, a mechanical anticompatibilization process. Two examples are high-speed melt spinning of fibers and melt blowing of fibers and films to form nonwoven/spun-bonded products. In summary, the scope of this invention includes the complete range of forming operations just described.

In general, void formation occurs independent of, and does not require, crystalline orientation of the matrix polymer. Opaque, microvoided films have been made in accordance with the methods of this invention using completely amorphous, noncrystallizing copolyesters as the matrix phase. Crystallizable/orientable (strain hardening) matrix materials are preferred for some properties like tensile strength and gas transmission barrier. On the other hand, amorphous matrix materials have special utility in other areas like tear resistance and heat sealability. The specific matrix composition can be tailored to meet many product needs. The complete range from crystalline to amorphous matrix polymer is part of the invention.

A transparent polymer base free of $TiO_2$ is preferred because the $TiO_2$ in the transparent polymer gives the reflective display materials an undesirable opalescence appearance. The $TiO_2$ pigmented transparent polymer of the prior art is also expensive because the $TiO_2$ must be dispersed into the entire thickness, typically from 100 to 180 micrometers. The $TiO_2$ also gives the transparent polymer support a slight yellow tint which is undesirable for a imaging display material. For use as a day/night display material, a transparent polymer support containing $TiO_2$ must also be tinted blue to offset the yellow tint of the polyester causing a loss in desired whiteness and adding cost to the display material. Concentration of the white pigment in the voided polyester layer allow for efficient use of the white pigment which improves image quality and reduces the cost of the imaging support.

In the formation of imaging elements it is important that they be designed to efficiently transport through digital printing equipment to minimize jamming and other problems. In such a case the back of said imaging member should have a roughness of between 0.3 and 2.0 micrometers. Furthermore, it is also desirable to control the roughness characteristic of the topmost side. It is desirable to incorporate roughness to help prevent finger printing and damage to the image side of the element. An improved roughness position also helps in assembling the display as a slightly non smooth surface will slide more easily into a display frame with protective over cover. In addition the roughened surface provides additional advantage in reducing gloss for those application that a softer mood or message is being created with the image material. The $TiO_2$ containing tone enhancing layer of the invention provides desired roughness that aids transport and helps in fingerprint prevention. The imaging element of this invention may also be designed wherein the top of said imaging member has a surface roughness of between 0.02 and 0.2 micrometers.

The structure of a preferred oriented, voided polyester imaging base where the image receiving layer is coated on the gelatin coated layers is as follows:

Gelatin sub coating

Voided polyester with $TiO_2$, blue tint, and optical brightener

Transparent polyester

Gelatin sub coating

As used herein, the phrase "photographic element" is a material that utilizes photosensitive silver halide in the formation of images. The photographic elements can be black and white, single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

For the display material of this invention, at least one image layer containing silver halide and a dye forming coupler located on the topside and bottom side of said imaging element is suitable. Applying the imaging layer to either the top and bottom is suitable for a photographic display material, but it is not sufficient to create a photographic display material that is optimum for both a reflection display and a transmission display. For the display material of this invention, at least one image layer comprises at least one dye forming coupler located on both the top and bottom of the imaging support of this invention is preferred. Applying an imaging layer to both the top and bottom of the support allows for the display material to have the required density for both reflective viewing and for transmission viewing of the image. This duplitized "day/night" photographic display material has significant commercial value in that the day/night display material can be used for both reflective viewing and transmission viewing. Prior art display materials were optimized for either transmission viewing or reflective viewing but not both simultaneously.

It has been found that the duplitized emulsion coverage should be in a range that is greater than 75% and less than 175% of typical emulsion coverages for reflective consumer paper that contain typical amounts of silver and coupler. At coverages of less than 75% on the front side it was found that a pleasing reflection print could not be obtained. Further, at coverages of less than 75% on the backside, pleasing transmission images could not be obtained. Coverages greater than 175% are undesirable because of the increased material expense and also because of the need for extended development times in the processing solutions. In a more preferred embodiment, emulsion laydowns should be between 100–150 % of that found for a typical reflective consumer color paper.

The display material of this invention wherein the amount of dye forming coupler is substantially the same on the top and bottom sides is most preferred because it allows for optimization of image density, while allowing for developer time less than 50 seconds. Further, coating substantially the same amount of light sensitive silver halide emulsion on both sides has the additional benefit of balancing the imaging element for image curl caused by the contraction and expansion of the hygroscopic gel typically found in photographic emulsions.

The photographic emulsions useful for this invention are generally prepared by precipitating silver halide crystals in a colloidal matrix by methods conventional in the art. The colloid is typically a hydrophilic sheet forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support using known coating techniques such as bead and curtain coating.

The silver halide emulsions utilized in this invention may be comprised of any halide distribution. Thus, they may be comprised of silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions. It is preferred, however, that the emulsions be predominantly silver chloride emulsions. By predominantly silver chloride, it is meant that the grains of the emulsion are greater than about 50 mole percent silver chloride. Preferably, they are greater than about 90 mole percent silver chloride; and optimally greater than about 95 mole percent silver chloride.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The photographic elements of the invention may utilize emulsions as described in *The Theory of the Photographic Process,* Fourth Edition, T. H. James, Macmillan Publishing Company, Inc., 1977, pages 151–152. Reduction sensitization has been known to improve the photographic sensitivity of silver halide emulsions. While reduction sensitized silver halide emulsions generally exhibit good photographic speed, they often suffer from undesirable fog and poor storage stability.

Reduction sensitization can be performed intentionally by adding reduction sensitizers, chemicals that reduce silver ions to form metallic silver atoms, or by providing a reducing environment such as high pH (excess hydroxide ion) and/or low pAg (excess silver ion). During precipitation of a silver halide emulsion, unintentional reduction sensitization can occur when, for example, silver nitrate or alkali solutions are added rapidly or with poor mixing to form emulsion grains. Also, precipitation of silver halide emulsions in the presence of ripeners (grain growth modifiers) such as thioethers, selenoethers, thioureas, or ammonia tends to facilitate reduction sensitization.

Examples of reduction sensitizers and environments which may be used during precipitation or spectral/chemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 789,823. Specific examples of reduction sensitizers or conditions, such as dimethylamineborane, stannous chloride, hydrazine, high pH (pH 8–11) and low pAg (pAg 1–7) ripening are discussed by S. Collier in Photographic Science and Engineering, 23, p. 113 (1979). Examples of processes for preparing intentionally reduction sensitized silver halide emulsions are described in EP 0 348 934 A1 (Yamashita), EP 0 369 491 (Yamashita), EP 0 371 388 (Ohashi), EP 0 396 424 A1 (Takada), EP 0 404 142 A1 (Yamada), and EP 0 435 355 A1 (Makino).

The photographic elements of this invention may use emulsions doped with Group VIII metals such as iridium, rhodium, osmium, and iron as described in *Research Disclosure,* September 1994, Item 36544, Section I, published by Kenneth Mason Publications, Ltd., Dudley Annex, 12a North Street, Emsworth, Hampshire PO10 7DQ, ENGLAND. Additionally, a general summary of the use of iridium in the sensitization of silver halide emulsions is contained in Carroll, "Iridium Sensitization: A Literature Review," Photographic Science and Engineering, Vol. 24, No. 6, 1980. A method of manufacturing a silver halide emulsion by chemically sensitizing the emulsion in the presence of an iridium salt and a photographic spectral sensitizing dye is described in U.S. Pat. No. 4,693,965. In some cases, when such dopants are incorporated, emulsions show an increased fresh fog and a lower contrast sensitometric curve when processed in the color reversal E-6 process as described in The British Journal of Photography Annual, 1982, pages 201–203.

A typical multicolor photographic element of the invention comprises the invention laminated support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like. The support of the invention may also be utilized for black and white photographic print elements.

When the base material of the invention with the integral diffusion layer is coated with silver halide photographic element, it is capable of excellent performance when exposed by either an electronic printing method or a conventional optical printing method. An electronic printing method comprises subjecting a radiation sensitive silver halide emulsion layer of a recording element to actinic radiation of at least $10^{-4}$ ergs/cm$^2$ for up to 100$\mu$ seconds duration in a pixel-by-pixel mode wherein the silver halide emulsion layer is comprised of silver halide grains as described above. A conventional optical printing method comprises subjecting a radiation sensitive silver halide emulsion layer of a recording element to actinic radiation of at least $10^{-4}$ ergs/cm$^2$ for $10^{-3}$ to 300 seconds in an imagewise mode wherein the silver halide emulsion layer is comprised of silver halide grains as described above. This invention in a preferred embodiment utilizes a radiation-sensitive emulsion comprised of silver halide grains (a) containing greater than 50 mole percent chloride, based on silver, (b) having greater than 50 percent of their surface area provided by {100} crystal faces, and (c) having a central portion accounting for from 95 to 99 percent of total silver and containing two dopants selected to satisfy each of the following class requirements: (i) a hexacoordination metal complex which satisfies the formula $$[ML_6]^n \quad \text{(I)}$$

wherein n is zero, −1, −2, −3, or −4; M is a filled frontier orbital polyvalent metal ion, other than iridium; and $L_6$ represents bridging ligands which can be independently selected, provided that least four of the ligands are anionic ligands, and at least one of the ligands is a cyano ligand or a ligand more electronegative than a cyano ligand; and (ii) an iridium coordination complex containing a thiazole or substituted thiazole ligand.

It has been discovered quite surprisingly that the combination of dopants (i) and (ii) provides greater reduction in reciprocity law failure than can be achieved with either dopant alone. Further, unexpectedly, the combination of dopants (i) and (ii) achieves reductions in reciprocity law failure beyond the simple additive sum achieved when employing either dopant class by itself. It has not been reported or suggested prior to this invention that the combination of dopants (i) and (ii) provides greater reduction in reciprocity law failure, particularly for high intensity and short duration exposures. The combination of dopants (i) and (ii) further unexpectedly achieves high intensity reciprocity with iridium at relatively low levels, and both high and low intensity reciprocity improvements even while using conventional gelatino-peptizer (e.g., other than low methionine gelatino-peptizer).

In a preferred practical application, the advantages of the invention can be transformed into increased throughput of digital substantially artifact-free color print images while exposing each pixel sequentially in synchronism with the digital data from an image processor.

In one embodiment, the present invention represents an improvement on the electronic printing method. Specifically, this invention in one embodiment is directed to an electronic printing method which comprises subjecting a radiation sensitive silver halide emulsion layer of a recording element to actinic radiation of at least $10^{-4}$ ergs/cm$^2$ for up to 100$\mu$ seconds duration in a pixel-by-pixel mode. The present invention realizes an improvement in reciprocity failure by selection of the radiation sensitive silver halide emulsion layer. While certain embodiments of the invention are specifically directed towards electronic printing, use of the emulsions and elements of the invention is not limited to such specific embodiment, and it is specifically contemplated that the emulsions and elements of the invention are also well suited for conventional optical printing.

It has been unexpectedly discovered that significantly improved reciprocity performance can be obtained for silver halide grains (a) containing greater than 50 mole percent chloride, based on silver, and (b) having greater than 50 percent of their surface area provided by {100} crystal faces by employing a hexacoordination complex dopant of class (i) in combination with an iridium complex dopant comprising a thiazole or substituted thiazole ligand. The reciprocity improvement is obtained for silver halide grains employing conventional gelatino-peptizer, unlike the contrast improvement described for the combination of dopants set forth in U.S. Pat. Nos. 5,783,373 and 5,783,378, which requires the use of low methionine gelatino-peptizers as discussed therein, and which states it is preferable to limit the concentration of any gelatino-peptizer with a methionine level of greater than 30 micromoles per gram to a concentration of less than 1 percent of the total peptizer employed. Accordingly, in specific embodiments of the invention, it is specifically contemplated to use significant levels (i.e., greater than 1 weight percent of total peptizer) of conventional gelatin (e.g., gelatin having at least 30 micromoles of methionine per gram) as a gelatino-peptizer for the silver halide grains of the emulsions of the invention. In preferred embodiments of the invention, gelatino-peptizer is employed which comprises at least 50 weight percent of gelatin containing at least 30 micromoles of methionine per gram, as it is frequently desirable to limit the level of oxidized low methionine gelatin which may be used for cost and certain performance reasons.

In a specific, preferred form of the invention it is contemplated to employ a class (i) hexacoordination complex dopant satisfying the formula:

$$[ML_6]^n \quad (I)$$

where n is zero, −1, −2, −3, or −4;

M is a filled frontier orbital polyvalent metal ion, other than iridium, preferably $Fe^{+2}$, $Ru^{+2}$, $Os^{+2}$, $Co^{+3}$, $Rh^{+3}$, $Pd^{+4}$ or $Pt^{+4}$, more preferably an iron, ruthenium or osmium ion, and most preferably a ruthenium ion;

$L_6$ represents six bridging ligands which can be independently selected, provided that least four of the ligands are anionic ligands and at least one (preferably at least 3 and optimally at least 4) of the ligands is a cyano ligand or a ligand more electronegative than a cyano ligand. Any remaining ligands can be selected from among various other bridging ligands, including aquo ligands, halide ligands (specifically, fluoride, chloride, bromide and iodide), cyanate ligands, thiocyanate ligands, selenocyanate ligands, tellurocyanate ligands, and azide ligands. Hexacoordinated transition metal complexes of class (i) which include six cyano ligands are specifically preferred.

Illustrations of specifically contemplated class (i) hexacoordination complexes for inclusion in the high chloride grains are provided by Olm et al U.S. Pat. No. 5,503,970 and Daubendiek et al U.S. Pat. Nos. 5,494,789 and 5,503,971, and Keevert et al U.S. Pat. No. 4,945,035, as well as Murakami et al Japanese Patent Application Hei-2[1990]-249588, and *Research Disclosure* Item 36736. Useful neutral and anionic organic ligands for class (ii) dopant hexacoordination complexes are disclosed by Olm et al U.S. Pat. No. 5,360,712 and Kuromoto et al U.S. Pat. No. 5,462,849.

Class (i) dopant is preferably introduced into the high chloride grains after at least 50 (most preferably 75 and optimally 80) percent of the silver has been precipitated, but before precipitation of the central portion of the grains has been completed. Preferably class (i) dopant is introduced before 98 (most preferably 95 and optimally 90) percent of the silver has been precipitated. Stated in terms of the fully precipitated grain structure, class (i) dopant is preferably present in an interior shell region that surrounds at least 50 (most preferably 75 and optimally 80) percent of the silver and, with the more centrally located silver, accounts the entire central portion (99 percent of the silver), most preferably accounts for 95 percent, and optimally accounts for 90 percent of the silver halide forming the high chloride grains. The class (i) dopant can be distributed throughout the interior shell region delimited above or can be added as one or more bands within the interior shell region.

Class (i) dopant can be employed in any conventional useful concentration. A preferred concentration range is from $10^{-8}$ to $10^{-3}$ mole per silver mole, most preferably from $10^{-6}$ to $5\times10^{-4}$ mole per silver mole.

The following are specific illustrations of class (i) dopants:

(i-1) $[Fe(CN)_6]^{-4}$
(i-2) $[Ru(CN)_6]^{-4}$
(i-3) $[Os(CN)_6]^{-4}$
(i-4) $[Rh(CN)_6]^{-3}$
(i-5) $[Co(CN)_6]^{-3}$
(i-6) $[Fe(pyrazine)(CN)_5]^{-4}$
(i-7) $[RuCl(CN)_5]^{-4}$
(i-8) $[OsBr(CN)_5]^{-4}$
(i-9) $[RhF(CN)_5]^{-3}$
(i-10) $[In(NCS)_6]^{-3}$
(i-11) $[FeCO(CN)_5]^{-3}$
(i-12) $[RuF_2(CN)_4]^{-4}$
(i-13) $[OsCl_2(CN)_4]^{-4}$
(i-14) $[RhI_2(CN)_4]^{-3}$
(i-15) $[Ga(NCS)_6]^{-3}$
(i-16) $[Ru(CN)_5(OCN)]^{-4}$
(i-17) $[Ru(CN)_5(N_3)]^{-4}$
(i-18) $[Os(CN)_5(SCN)]^{-4}$
(i-19) $[Rh(CN)_5(SeCN)]^{-3}$
(i-20) $[Os(CN)Cl_5]^{-4}$
(i-21) $[Fe(CN)_3Cl_3]^{-3}$
(i-22) $[Ru(CO)_2(CN)_4]^{-1}$ When the class (i) dopants have a net negative charge, it is appreciated that they are associated with a counter ion when added to the reaction vessel during precipitation. The counter ion is of little importance, since it is ionically dissociated from the dopant in solution and is not incorporated within the grain. Common counter ions known to be fully compatible with silver chloride precipitation, such as ammonium and alkali metal ions, are contemplated. It is noted that the same comments apply to class (ii) dopants, otherwise described below.

The class (ii) dopant is an iridium coordination complex containing at least one thiazole or substituted thiazole ligand. Careful scientific investigations have revealed Group VIII hexahalo coordination complexes to create deep electron traps, as illustrated R. S. Eachus, R. E. Graves and M. T. Olm *J. Chem. Phys.,* Vol. 69, pp. 4580–7 (1978) and *Physica Status Solidi A,* Vol. 57, 429–37 (1980) and R. S. Eachus and M. T. Olm *Annu. Rep. Prog. Chem. Sect. C. Phys. Chem.,* Vol. 83, 3, pp. 3–48 (1986). The class (ii) dopants employed in the practice of this invention are believed to create such deep electron traps. The thiazole ligands may be substituted with any photographically acceptable substituent which does not prevent incorporation of the dopant into the silver halide grain. Exemplary substituents include lower alkyl (e.g., alkyl groups containing 1–4 carbon atoms), and specifically methyl. A specific example of a substituted thiazole ligand which may be used in accordance with the invention is 5-methylthiazole. The class (ii) dopant preferably is an iridium coordination complex having ligands each of which are more electropositive than a cyano ligand. In a specifically preferred form the remaining non-thiazole or non-substituted-thiazole ligands of the coordination complexes forming class (ii) dopants are halide ligands.

It is specifically contemplated to select class (ii) dopants from among the coordination complexes containing organic ligands disclosed by Olm et al U.S. Pat. No. 5,360,712; Olm et al U.S. Pat. No. 5,457,021; and Kuromoto et al U.S. Pat. No. 5,462,849.

In a preferred form it is contemplated to employ as a class (ii) dopant a hexacoordination complex satisfying the formula:

$$[IrL^1{}_6]^{n'} \quad (II)$$

wherein n' is zero, −1, −2, −3, or −4; and $L^1{}_6$ represents six bridging ligands which can be independently selected, provided that at least four of the ligands are anionic ligands, each of the ligands is more electropositive than a cyano ligand, and at least one of the ligands comprises a thiazole or substituted thiazole ligand. In a specifically preferred form at least four of the ligands are halide ligands, such as chloride or bromide ligands.

Class (ii) dopant is preferably introduced into the high chloride grains after at least 50 (most preferably 85 and optimally 90) percent of the silver has been precipitated, but before precipitation of the central portion of the grains has been completed. Preferably class (ii) dopant is introduced before 99 (most preferably 97 and optimally 95) percent of the silver has been precipitated. Stated in terms of the fully precipitated grain structure, class (ii) dopant is preferably present in an interior shell region that surrounds at least 50 (most preferably 85 and optimally 90) percent of the silver and, with the more centrally located silver, accounts the entire central portion (99 percent of the silver), most preferably accounts for 97 percent, and optimally accounts for 95 percent of the silver halide forming the high chloride grains. The class (ii) dopant can be distributed throughout the interior shell region delimited above or can be added as one or more bands within the interior shell region.

Class (ii) dopant can be employed in any conventional useful concentration. A preferred concentration range is from $10^{-9}$ to $10^{-4}$ mole per silver mole. Iridium is most preferably employed in a concentration range of from $10^{-8}$ to $10^{-5}$ mole per silver mole.

Specific illustrations of class (ii) dopants are the following:

(ii-1) $[IrCl_5(\text{thiazole})]^{-2}$
(ii-2) $[IrCl_4(\text{thiazole})_2]^{-1}$
(ii-3) $[IrBr_5(\text{thiazole})]^{-2}$
(ii-4) $[IrBr_4(\text{thiazole})_2]^{-1}$
(ii-5) $[IrCl_5(\text{5-methylthiazole})]^{-2}$
(ii-6) $[IrCl_4(\text{5-methylthiazole})_2]^{-1}$
(ii-7) $[IrBr_5(\text{5-methylthiazole})]^{-2}$
(ii-8) $[IrBr_4(\text{5-methylthiazole})_2]^{-1}$ In one preferred aspect of the invention in a layer using a magenta dye forming coupler, a class (ii) dopant in combination with an $OsCl_5(NO)$ dopant has been found to produce a preferred result.

Emulsions demonstrating the advantages of the invention can be realized by modifying the precipitation of conventional high chloride silver halide grains having predominantly (>50%) {100} crystal faces by employing a combination of class (i) and (ii) dopants as described above.

The silver halide grains precipitated contain greater than 50 mole percent chloride, based on silver. Preferably the grains contain at least 70 mole percent chloride and, optimally at least 90 mole percent chloride, based on silver. Iodide can be present in the grains up to its solubility limit, which is in silver iodochloride grains, under typical conditions of precipitation, about 11 mole percent, based on silver. It is preferred for most photographic applications to limit iodide to less than 5 mole percent iodide, most preferably less than 2 mole percent iodide, based on silver.

Silver bromide and silver chloride are miscible in all proportions. Hence, any portion, up to 50 mole percent, of the total halide not accounted for chloride and iodide, can be bromide. For color reflection print (i.e., color paper) uses bromide is typically limited to less than 10 mole percent based on silver, and iodide is limited to less than 1 mole percent based on silver.

In a widely used form high chloride grains are precipitated to form cubic grains--that is, grains having {100} major faces and edges of equal length. In practice ripening effects usually round the edges and corners of the grains to some extent. However, except under extreme ripening conditions substantially more than 50 percent of total grain surface area is accounted for by {100} crystal faces.

High chloride tetradecahedral grains are a common variant of cubic grains. These grains contain 6 {100} crystal faces and 8 {100} crystal faces. Tetradecahedral grains are within the contemplation of this invention to the extent that greater than 50 percent of total surface area is accounted for by {100} crystal faces.

Although it is common practice to avoid or minimize the incorporation of iodide into high chloride grains employed in color paper, it is has been recently observed that silver iodochloride grains with {100} crystal faces and, in some instances, one or more {111} faces offer exceptional levels of photographic speed. In the these emulsions iodide is incorporated in overall concentrations of from 0.05 to 3.0 mole percent, based on silver, with the grains having a surface shell of greater than 50 Å that is substantially free of iodide and a interior shell having a maximum iodide concentration that surrounds a core accounting for at least 50 percent of total silver. Such grain structures are illustrated by Chen et al EPO 0 718 679.

In another improved form the high chloride grains can take the form of tabular grains having {100} major faces. Preferred high chloride {100} tabular grain emulsions are those in which the tabular grains account for at least 70 (most preferably at least 90) percent of total grain projected area. Preferred high chloride {100} tabular grain emulsions have average aspect ratios of at least 5 (most preferably at least >8). Tabular grains typically have thicknesses of less than 0.3 $\mu$m, preferably less than 0.2 $\mu$m, and optimally less than 0.07 $\mu$m. High chloride {100} tabular grain emulsions and their preparation are disclosed by Maskasky U.S. Pat. Nos. 5,264,337 and 5,292,632; House et al U.S. Pat. No. 5,320,938; Brust et al U.S. Pat. No. 5,314,798; and Chang et al U.S. Pat. No. 5,413,904.

Once high chloride grains having predominantly {100} crystal faces have been precipitated with a combination of class (i) and class (ii) dopants described above, chemical and spectral sensitization, followed by the addition of conventional addenda to adapt the emulsion for the imaging application of choice can take any convenient conventional form. These conventional features are illustrated by *Research Disclosure,* Item 38957, cited above, particularly:

III. Emulsion washing;
IV. Chemical sensitization;
V. Spectral sensitization and desensitization;
VII. Antifoggants and stabilizers;
VIII. Absorbing and scattering materials;
IX. Coating and physical property modifying addenda; and
X. Dye image formers and modifiers.

Some additional silver halide, typically less than 1 percent, based on total silver, can be introduced to facilitate chemical sensitization. It is also recognized that silver halide can be epitaxially deposited at selected sites on a host grain to increase its sensitivity. For example, high chloride {100} tabular grains with corner epitaxy are illustrated by Maskasky U.S. Pat. No. 5,275,930. For the purpose of providing a clear demarcation, the term "silver halide grain" is herein employed to include the silver necessary to form the grain up to the point that the final {100} crystal faces of the grain are formed. Silver halide later deposited that does not overlie the {100} crystal faces previously formed accounting for at least 50 percent of the grain surface area is excluded in determining total silver forming the silver halide grains. Thus, the silver forming selected site epitaxy is not part of the silver halide grains while silver halide that deposits and provides the final {100} crystal faces of the grains is included in the total silver forming the grains, even when it differs significantly in composition from the previously precipitated silver halide.

Image dye-forming couplers may be included in the element such as couplers that form cyan dyes upon reaction with oxidized color developing agents which are described in such representative patents and publications as: U.S. Pat. Nos. 2,367,531; 2,423,730; 2,474,293; 2,772,162; 2,895,826; 3,002,836; 3,034,892; 3,041,236; 4,883,746 and "Farbkuppler—Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan couplers described in, for instance, European Patent Application Nos. 491,197; 544,322; 556,700; 556,777; 565,096; 570,006; and 574,948.

Typical cyan couplers are represented by the following formulas:

CYAN-1

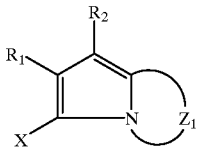

CYAN-2

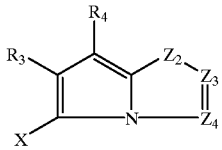

CYAN-3

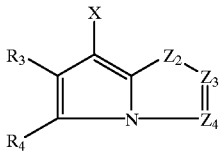

CYAN-4

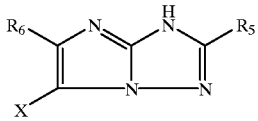

wherein $R_1$, $R_5$ and $R_8$ each represents a hydrogen or a substituent; $R_2$ represents a substituent; $R_3$, $R_4$ and $R_7$ each represents an electron attractive group having a Hammett's substituent constant $\sigma_{para}$ of 0.2 or more and the sum of the $\sigma_{para}$ values of $R_3$ and $R_4$ is 0.65 or more; $R_6$ represents an electron attractive group having a Hammett's substituent constant $\sigma_{para}$ of 0.35 or more; X represents a hydrogen or a coupling-off group; $Z_1$ represents nonmetallic atoms necessary for forming a nitrogen-containing, six-membered, heterocyclic ring which has at least one dissociative group; $Z_2$ represents —C($R_7$)═ and —N═; and $Z_3$ and $Z_4$ each represents —C($R_8$)═ and —N═.

Even more preferable are cyan couplers of the following formulas:

CYAN-5

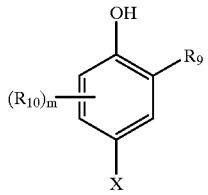

CYAN-6

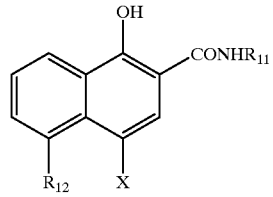

wherein $R_9$ represents a substituent (preferably a carbamoyl, ureido, or carbonamido group); $R_{10}$ represents a substituent (preferably individually selected from halogens, alkyl, and carbonamido groups); $R_{11}$ represents ballast substituent; $R_{12}$ represents a hydrogen or a substituent (preferably a carbonamido or sulphonamido group); X represents a hydrogen or a coupling-off group; and m is from 1–3.

A dissociative group has an acidic proton, e.g., —NH—, —CH(R)—, etc., that preferably has a pKa value of from 3 to 12 in water. Hammett's rule is an empirical rule proposed by L. P. Hammett in 1935 for the purpose of quantitatively discussing the influence of substituents on reactions or equilibria of a benzene derivative having the substituent thereon. This rule has become widely accepted. The values for Hammett's substituent constants can be found or measured as is described in the literature. For example, see C. Hansch and A. J. Leo, *J. Med. Chem.,* 16, 1207 (1973); *J. Med. Chem.,* 20, 304 (1977); and J. A. Dean, *Lange's Handbook of Chemistry,* 12th Ed. (1979) (McGraw-Hill).

Another type of preferred cyan coupler is an "NB coupler" which is a dye-forming coupler which is capable of coupling with the developer 4-amino-3-methyl-N-ethyl-N-(2-methanesulfonamidoethyl) aniline sesquisulfate hydrate to form a dye for which the left bandwidth (LBW) of its absorption spectra upon "spin coating" of a 3% w/v solution of the dye in di-n-butyl sebacate solvent is at least 5 nm. less than the LBW for a 3% w/v solution of the same dye in acetonitrile. The LBW of the spectral curve for a dye is the distance between the left side of the spectral curve and the wavelength of maximum absorption measured at a density of half the maximum.

The "spin coating" sample is prepared by first preparing a solution of the dye in di-n-butyl sebacate solvent (3% w/v). If the dye is insoluble, dissolution is achieved by the addition of some methylene chloride. The solution is filtered and 0.1–0.2 ml is applied to a clear polyethylene terephthalate support (approximately 4 cm×4 cm) and spun at 4,000 RPM using the Spin Coating equipment, Model No. EC101, available from Headway Research Inc., Garland Tex. The transmission spectra of the so prepared dye samples are then recorded.

Preferred "NB couplers" form a dye which, in n-butyl sebacate, has a LBW of the absorption spectra upon "spin coating" which is at least 15 nm, preferably at least 25 nm, less than that of the same dye in a 3% solution (w/v) in acetonitrile.

In a preferred embodiment, the cyan dye-forming "NB coupler" useful in the invention has the formula (IA)

(IA)

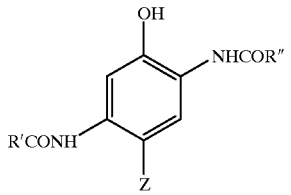

wherein

R' and R" are substituents selected such that the coupler is a "NB coupler", as herein defined; and Z is a hydrogen atom or a group which can be split off by the reaction of the coupler with an oxidized color developing agent.

The coupler of formula (IA) is a 2,5-diamido phenolic cyan coupler wherein the substituents R' and R" are preferably independently selected from unsubstituted or substituted alkyl, aryl, amino, alkoxy and heterocyclyl groups.

In a further preferred embodiment, the "NB coupler" has the formula (I):

(I)

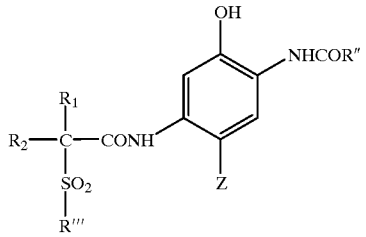

wherein

R" and R'" are independently selected from unsubstituted or substituted alkyl, aryl, amino, alkoxy and heterocyclyl groups and Z is as hereinbefore defined;

$R_1$ and $R_2$ are independently hydrogen or an unsubstituted or substituted alkyl group; and Typically, R" is an alkyl, amino or aryl group, suitably a phenyl group. R'" is desirably an alkyl or aryl group or a 5- to 10-membered heterocyclic ring which contains one or more heteroatoms selected from nitrogen, oxygen and sulfur, which ring group is unsubstituted or substituted.

In the preferred embodiment the coupler of formula (I) is a 2,5-diamido phenol in which the 5-amido moiety is an amide of a carboxylic acid which is substituted in the alpha position by a particular sulfone (—$SO_2$—) group such as, for example, described in U.S. Pat. No. 5,686,235. The sulfone moiety is an unsubstituted or substituted alkylsulfone or a heterocyclyl sulfone or it is an arylsulfone, which is preferably substituted, in particular in the meta and/or para position.

Couplers having these structures of formulae (I) or (IA) comprise cyan dye-forming "NB couplers" which form image dyes having very sharp-cutting dye hues on the short wavelength side of the absorption curves with absorption maxima ($\lambda_{max}$) which are shifted hypsochromically and are generally in the range of 620–645 nm, which is ideally suited for producing excellent color reproduction and high color saturation in color photographic papers.

Referring to formula (I), $R_1$ and $R_2$ are independently hydrogen or an unsubstituted or substituted alkyl group, preferably having from 1 to 24 carbon atoms and, in particular, 1 to 10 carbon atoms, suitably a methyl, ethyl, n-propyl, isopropyl, butyl or decyl group or an alkyl group substituted with one or more fluoro, chloro or bromo atoms, such as a trifluoromethyl group. Suitably, at least one of $R_1$ and $R_2$ is a hydrogen atom, and if only one of $R_1$ and $R_2$ is a hydrogen atom, then the other is preferably an alkyl group having 1 to 4 carbon atoms, more preferably 1 to 3 carbon atoms, and desirably two carbon atoms.

As used herein and throughout the specification unless where specifically stated otherwise, the term "alkyl" refers to an unsaturated or saturated straight or branched chain alkyl group, including alkenyl, and includes aralkyl and cyclic alkyl groups, including cycloalkenyl, having 3–8 carbon atoms and the term 'aryl' includes specifically fused aryl.

In formula (I), R" is suitably an unsubstituted or substituted amino, alkyl or aryl group or a 5- to 10-membered heterocyclic ring which contains one or more heteroatoms selected from nitrogen, oxygen and sulfur, which ring is unsubstituted or substituted, but is more suitably an unsubstituted or substituted phenyl group.

Examples of suitable substituent groups for this aryl or heterocyclic ring include cyano, chloro, fluoro, bromo, iodo, alkyl- or aryl-carbonyl, alkyl- or aryl-oxycarbonyl, carbonamido, alkyl- or aryl-carbonamido, alkyl- or aryl-sulfonyl, alkyl- or aryl-sulfonyloxy, alkyl- or aryl-oxysulfonyl, alkyl- or aryl-sulfoxide, alkyl- or aryl-sulfamoyl, alkyl- or aryl-sulfonamido, aryl, alkyl, alkoxy, aryloxy, nitro, alkyl- or aryl-ureido and alkyl- or aryl-carbamoyl groups, any of which may be further substituted. Preferred groups are halogen, cyano, alkoxycarbonyl, alkylsulfamoyl, alkyl-sulfonamido, alkylsulfonyl, carbamoyl, alkylcarbamoyl or alkylcarbonamido. Suitably, R" is a 4-chlorophenyl, 3,4-di-chlorophenyl, 3,4-difluorophenyl, 4-cyanophenyl, 3-chloro-4-cyanophenyl, pentafluorophenyl, or a 3- or 4-sulfonamidophenyl group.

In formula (I) when R'" is alkyl, it may be unsubstituted or substituted with a substituent such as halogen or alkoxy. When R'" is aryl or a heterocycle, it may be substituted. Desirably, it is not substituted in the position alpha to the sulfonyl group.

In formula (I), when R'" is a phenyl group, it may be substituted in the meta and/or para positions with 1 to 3 substituents independently selected from the group consisting of halogen, and unsubstituted or substituted alkyl, alkoxy, aryloxy, acyloxy, acylamino, alkyl- or aryl-sulfonyloxy, alkyl- or aryl-sulfamoyl, alkyl- or aryl-sulfamoylamino, alkyl- or aryl-sulfonamido, alkyl- or aryl-ureido, alkyl- or aryl-oxycarbonyl, alkyl- or aryl-oxycarbonylamino and alkyl- or aryl-carbamoyl groups.

In particular, each substituent may be an alkyl group such as methyl, t-butyl, heptyl, dodecyl, pentadecyl, octadecyl or 1,1,2,2-tetramethylpropyl; an alkoxy group such as methoxy, t-butoxy, octyloxy, dodecyloxy, tetradecyloxy, hexadecyloxy or octadecyloxy; an aryloxy group such as phenoxy, 4-t-butylphenoxy or 4-dodecyl-phenoxy; an alkyl- or aryl-acyloxy group such as acetoxy or dodecanoyloxy; an alkyl- or aryl-acylamino group such as acetamido, hexadecanamido or benzamido; an alkyl- or aryl-sulfonyloxy group such as methyl-sulfonyloxy, dodecylsulfonyloxy or 4-methylphenyl-sulfonyloxy; an alkyl- or aryl-sulfamoyl-group such as N-butylsulfamoyl or N-4-t-butylphenylsulfamoyl; an alkyl- or aryl-sulfamoylamino group such as N-butyl-sulfamoylamino or N-4-t-butylphenylsulfamoyl-amino; an alkyl- or aryl-sulfonamido group such as methane-sulfonamido, hexadecanesulfonamido or 4-chlorophenyl-sulfonamido; an alkyl- or aryl-ureido group such as methylureido or phenylureido; an alkoxy- or aryloxy-carbonyl such as methoxycarbonyl or phenoxycarbonyl; an alkoxy- or aryloxy-carbonylamino group such as methoxycarbonylamino or phenoxycarbonylamino; an alkyl- or aryl-carbamoyl group such as N-butylcarbamoyl or N-methyl-N-dodecylcarbamoyl; or a perfluoroalkyl group such as trifluoromethyl or heptafluoropropyl.

Suitably, the above substituent groups have 1 to 30 carbon atoms, more preferably 8 to 20 aliphatic carbon atoms. A desirable substituent is an alkyl group of 12 to 18 aliphatic carbon atoms such as dodecyl, pentadecyl or octadecyl or an alkoxy group with 8 to 18 aliphatic carbon atoms such as dodecyloxy and hexadecyloxy or a halogen such as a meta or para chloro group, carboxy or sulfonamido. Any such groups may contain interrupting heteroatoms such as oxygen to form e.g. polyalkylene oxides.

In formula (I) or (IA), Z is a hydrogen atom or a group which can be split off by the reaction of the coupler with an oxidized color developing agent, known in the photographic art as a 'coupling-off group' and may preferably be hydrogen, chloro, fluoro, substituted aryloxy or mercaptotetrazole, more preferably hydrogen or chloro.

The presence or absence of such groups determines the chemical equivalency of the coupler, i.e., whether it is a 2-equivalent or 4-equivalent coupler, and its particular identity can modify the reactivity of the coupler. Such groups can advantageously affect the layer in which the coupler is coated, or other layers in the photographic recording material by performing, after release from the coupler, functions such as dye formation, dye hue adjustment, development acceleration or inhibition, bleach acceleration or inhibition, electron transfer facilitation, color correction, and the like.

Representative classes of such coupling-off groups include, for example, halogen, alkoxy, aryloxy, heterocyclyloxy, sulfonyloxy, acyloxy, acyl, heterocyclylsulfonamido, heterocyclylthio, benzothiazolyl, phosophonyloxy, alkylthio, arylthio, and arylazo. These coupling-off groups are described in the art, for example, in U.S. Pat. Nos. 2,455,169; 3,227,551; 3,432,521; 3,467,563; 3,617,291; 3,880,661; 4,052,212; and 4,134,766; and in U.K. Patent Nos. and published applications 1,466,728; 1,531,927; 1,533,039; 2,066,755A, and 2,017,704A. Halogen, alkoxy, and aryloxy groups are most suitable.

Examples of specific coupling-off groups are —Cl, —F, —Br, —SCN, $—OCH_3$, $—OC_6H_5$, $—OCH_2C(=O)NHCH_2CH_2OH$, $—OCH_2C(O)NHCH_2CH_2OCH_3$, $—OCH_2C(O)NHCH_2CH_2OC(=O)OCH_3$, $—P(=O)(OC_2H_5)_2$, $—SCH_2CH_2COOH$,

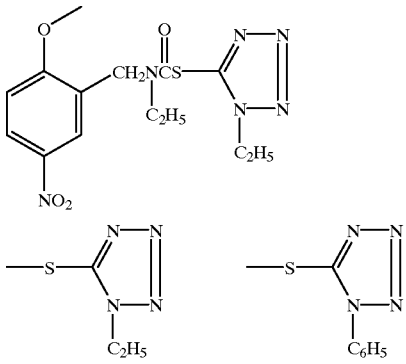

-continued

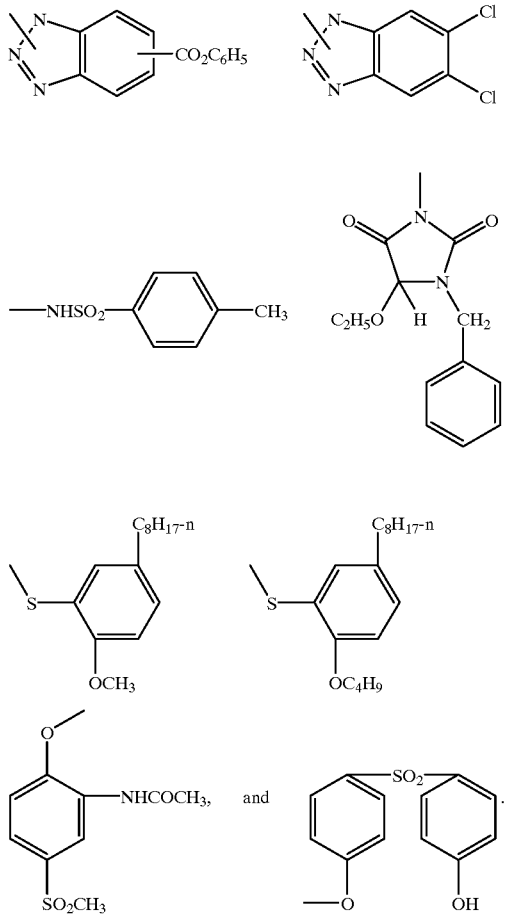

Typically, the coupling-off group is a chlorine atom, hydrogen atom, or p-methoxyphenoxy group.

It is essential that the substituent groups be selected so as to adequately ballast the coupler and the resulting dye in the organic solvent in which the coupler is dispersed. The ballasting may be accomplished by providing hydrophobic substituent groups in one or more of the substituent groups. Generally a ballast group is an organic radical of such size and configuration as to confer on the coupler molecule sufficient bulk and aqueous insolubility as to render the coupler substantially nondiffusible from the layer in which it is coated in a photographic element. Thus, the combination of substituent are suitably chosen to meet these criteria. To be effective, the ballast will usually contain at least 8 carbon atoms and typically contains 10 to 30 carbon atoms. Suitable ballasting may also be accomplished by providing a plurality of groups which, in combination, meet these criteria. In the preferred embodiments of the invention, $R_1$ in formula (I) is a small alkyl group or hydrogen. Therefore, in these embodiments the ballast would be primarily located as part of the other groups. Furthermore, even if the coupling-off group Z contains a ballast, it is often necessary to ballast the other substituents as well, since Z is eliminated from the molecule upon coupling; thus, the ballast is most advantageously provided as part of groups other than Z.

The following examples further illustrate preferred cyan couplers to be used in the invention. It is not to be construed that the present invention is limited to these examples.

IC-1
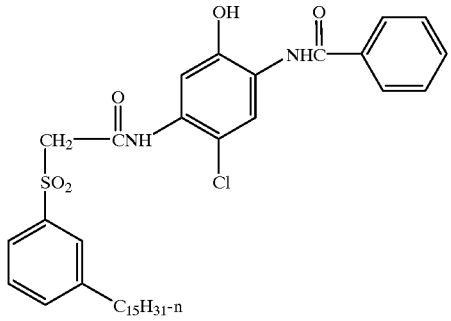
IC-2
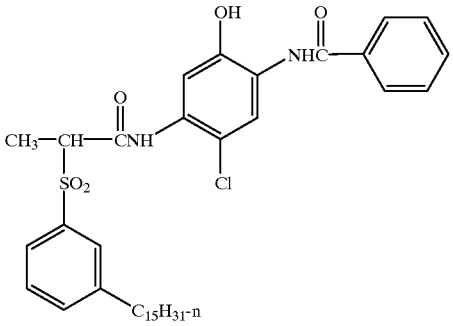
IC-3
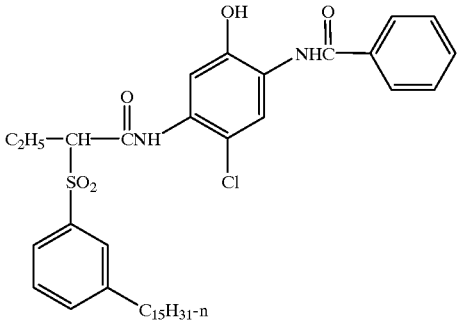
IC-4
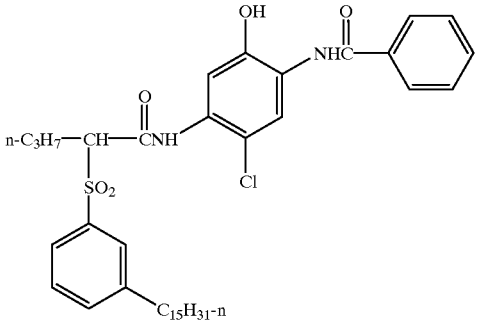
-continued
IC-5
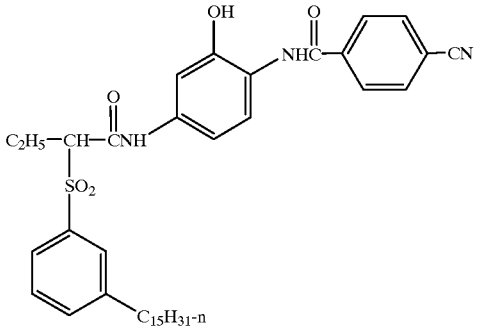
IC-6
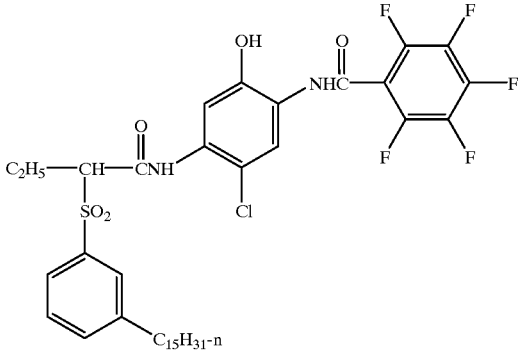
IC-6
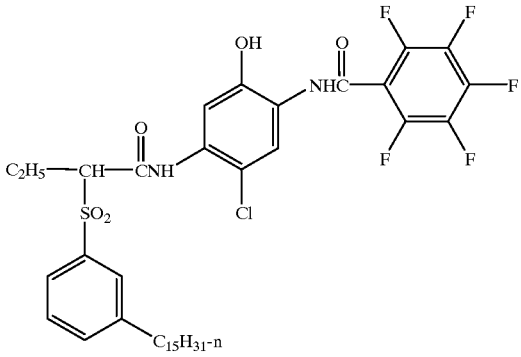
IC-7
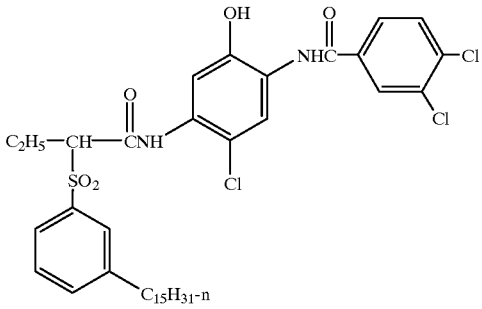

-continued
IC-8
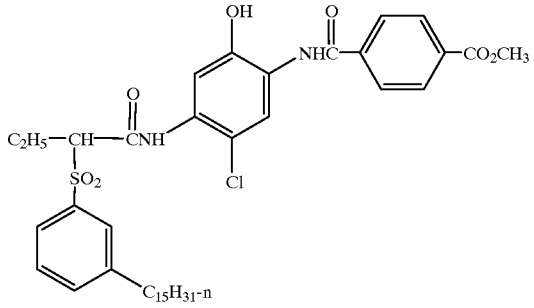
IC-9
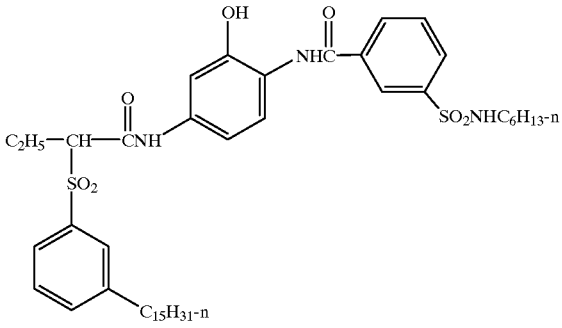
IC-10
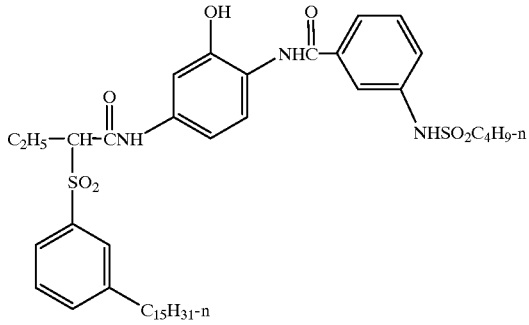
IC-11
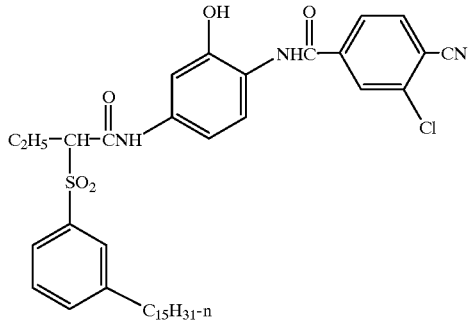
-continued
IC-12
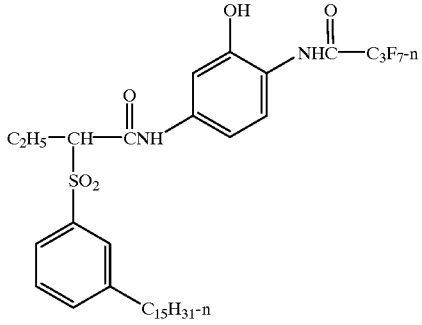
IC-13
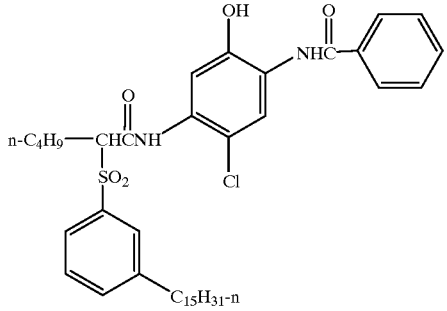
IC-14
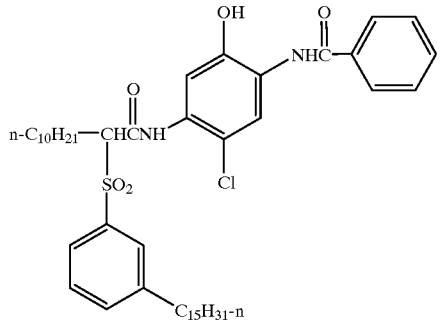
IC-15
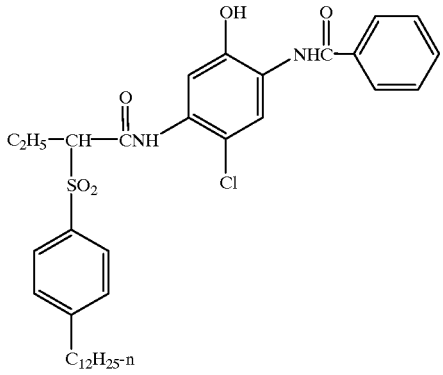

-continued
IC-16
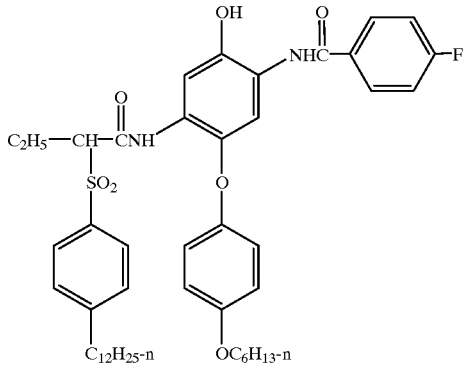
IC-17
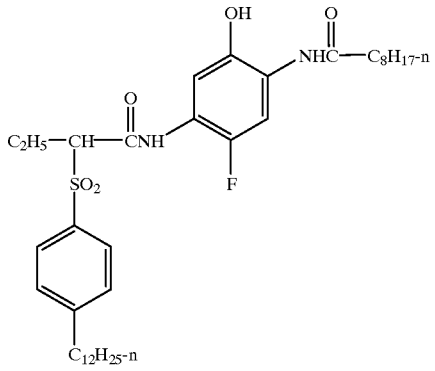
IC-18
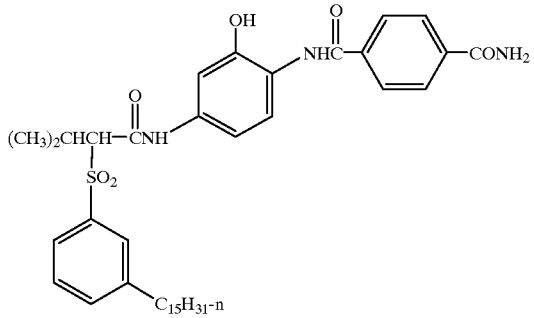
IC-19
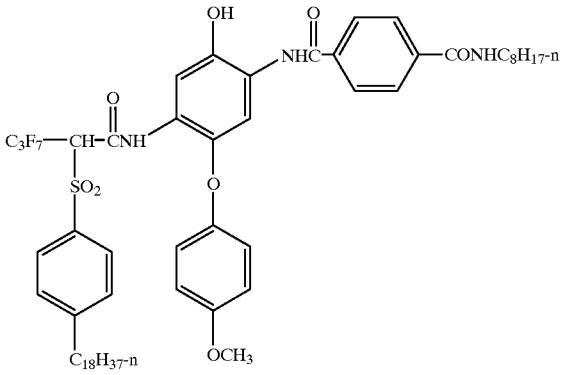
-continued
IC-20
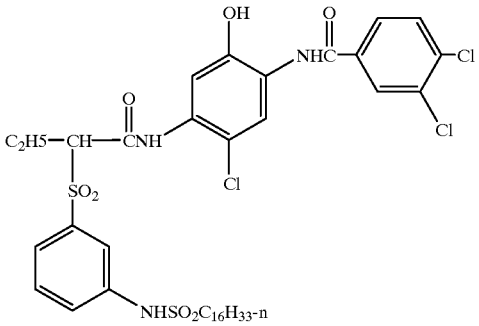
IC-21
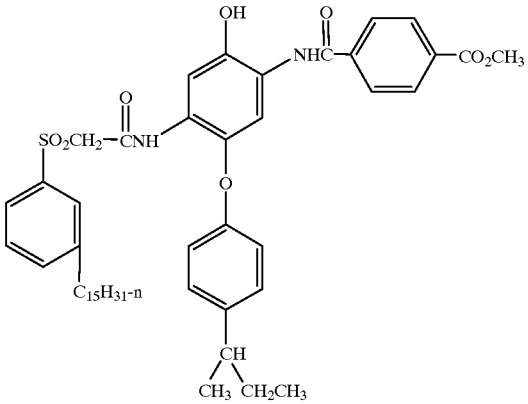
IC-22
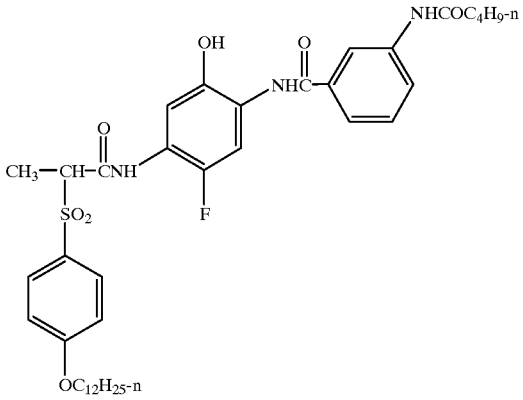
IC-23
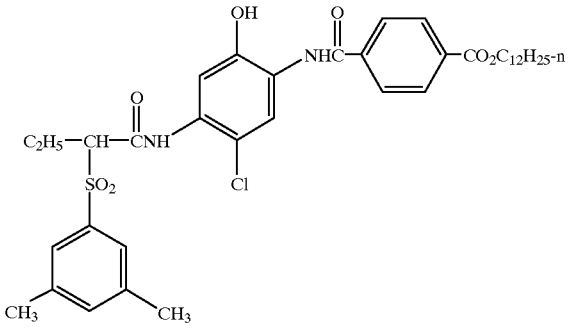

-continued
IC-24
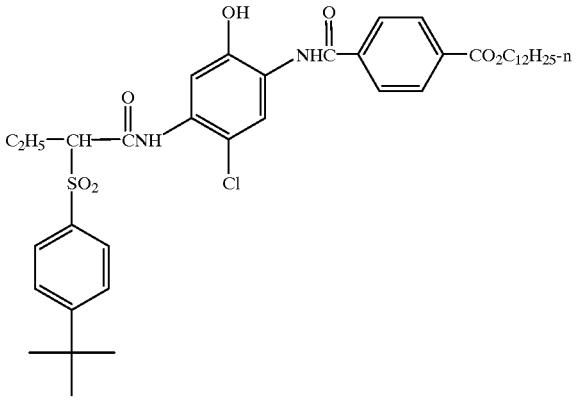
IC-25
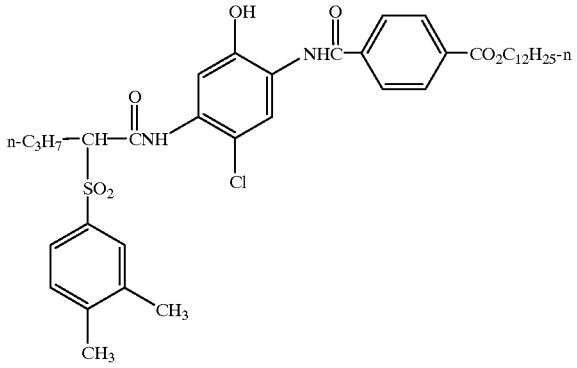
IC-26
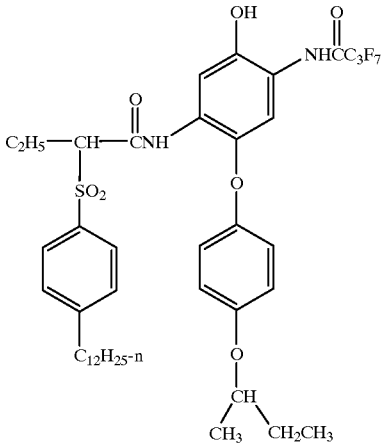
-continued
IC-27
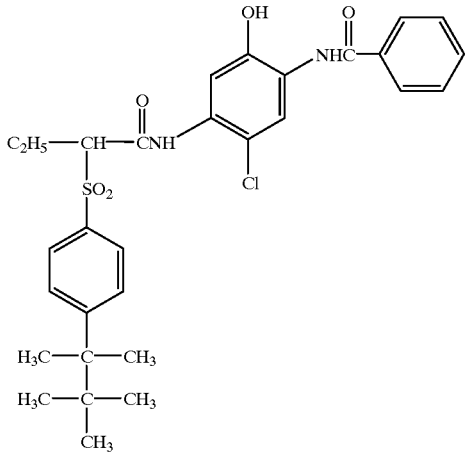
IC-28
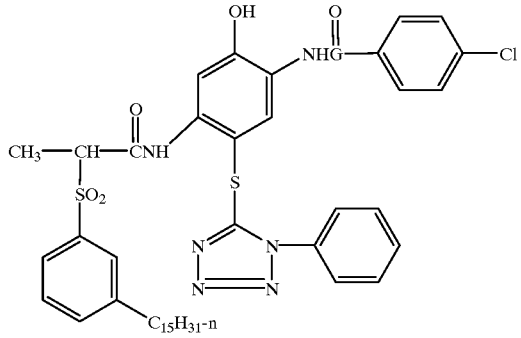
IC-29
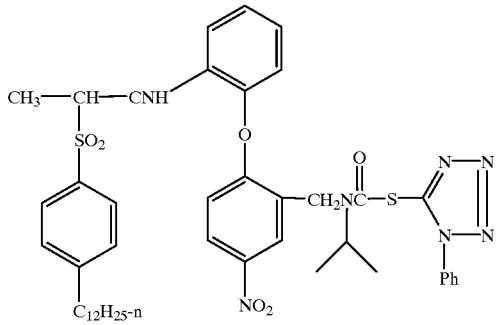
IC-29
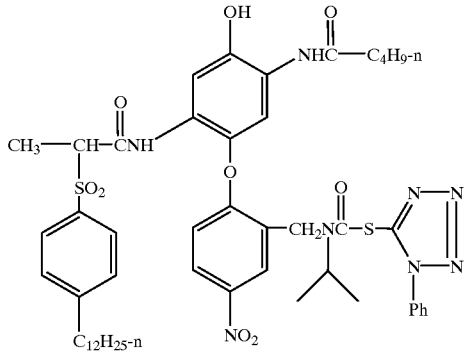

-continued
IC-30
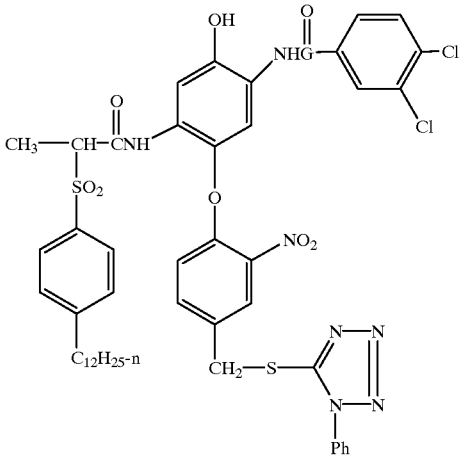
IC-31
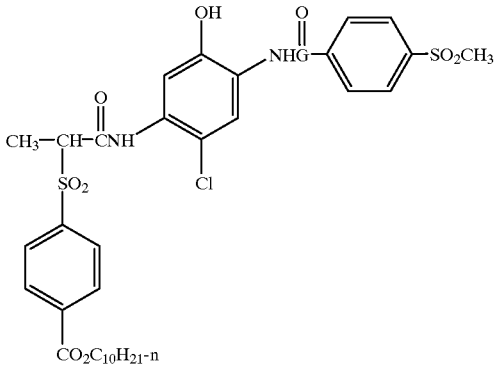
IC-32
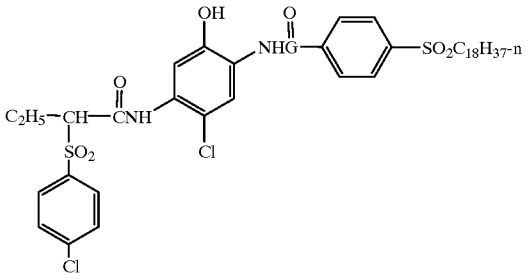
IC-33
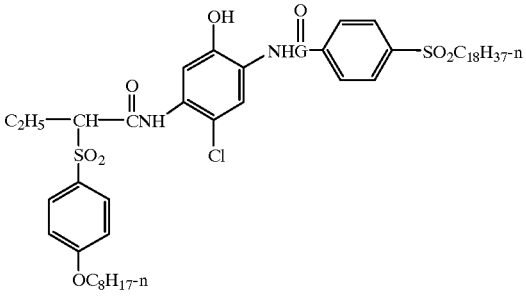
-continued
IC-34
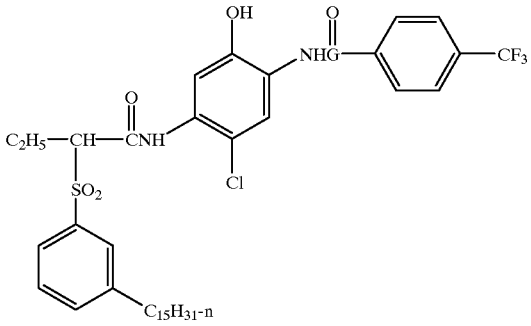
IC-34
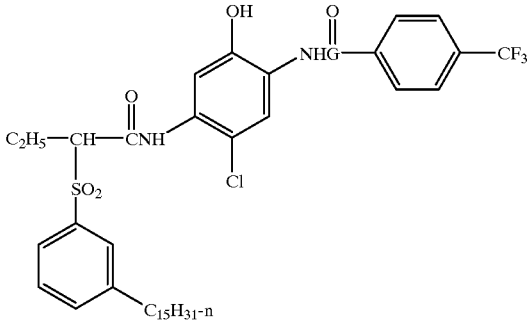
IC-35
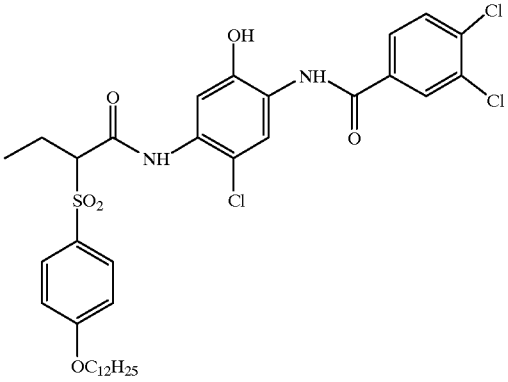
IC-36
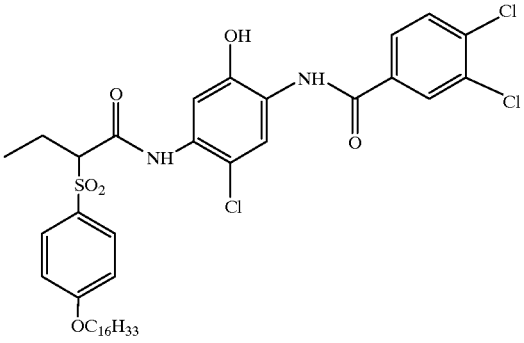

-continued

IC-37

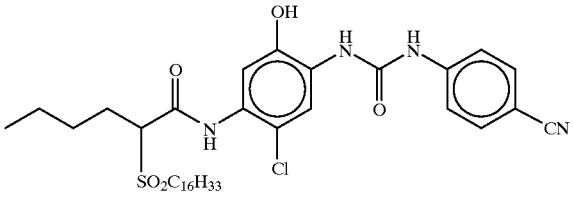

IC-38

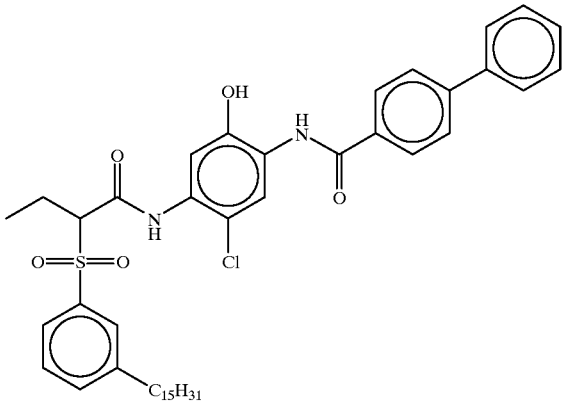

IC-39

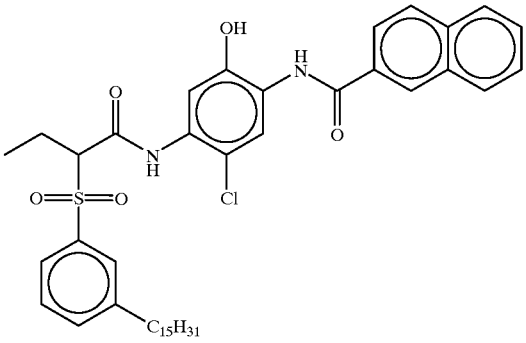

IC-39

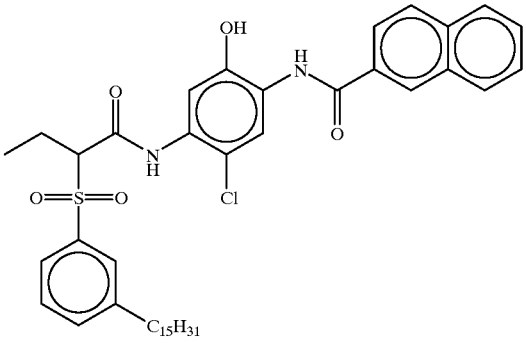

-continued

IC-40

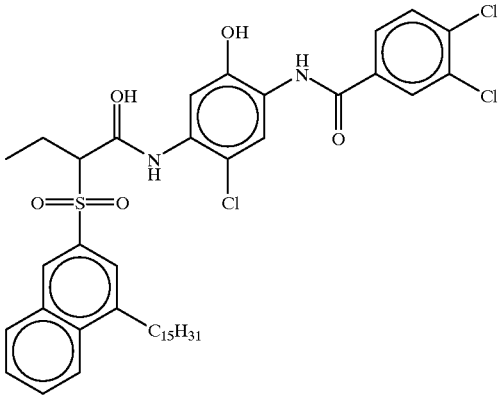

Preferred couplers are IC-3, IC-7, IC-35, and IC-36 because of their suitably narrow left bandwidths.

Couplers that form magenta dyes upon reaction with oxidized color developing agent are described in such representative patents and publications as: U.S. Pat. Nos. 2,311,082; 2,343,703; 2,369,489; 2,600,788; 2,908,573; 3,062,653; 3,152,896; 3,519,429; 3,758,309; and "Farbkuppler-eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Especially preferred couplers are 1H-pyrazolo [5,1-c]-1,2,4-triazole and 1H-pyrazolo [1,5-b]-1,2,4-triazole. Examples of 1H-pyrazolo [5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent applications 176,804; 177,765; U.S Pat. Nos. 4,659,652; 5,066,575; and 5,250,400.

Typical pyrazoloazole and pyrazolone couplers are represented by the following formulas:

MAGENTA-1

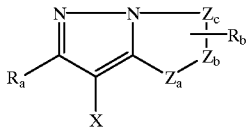

MAGENTA-2

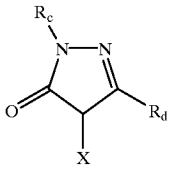

wherein $R_a$ and $R_b$ independently represent H or a substituent; $R_c$ is a substituent (preferably an aryl group); $R_d$ is a substituent (preferably an anilino, carbonamido, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$.

Specific examples of such couplers are:

M-1

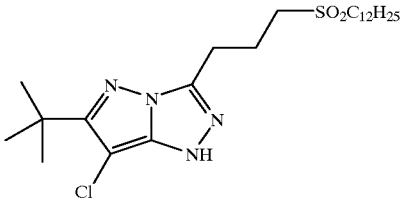

M-2

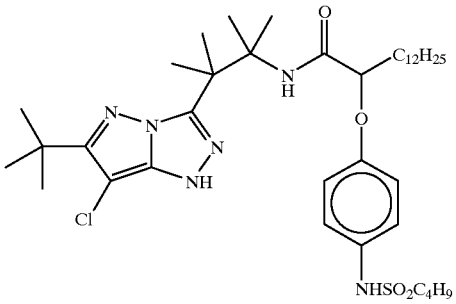

M-3

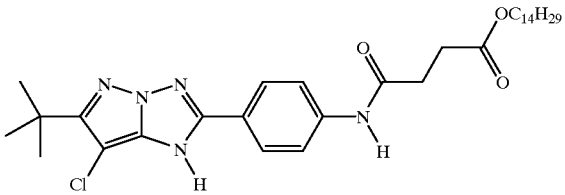

M-4

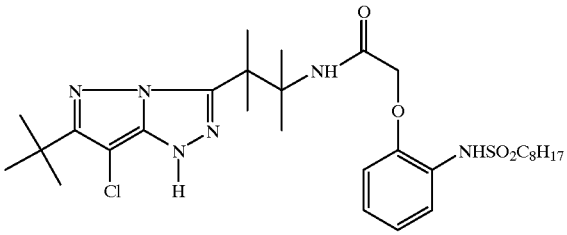

M-5

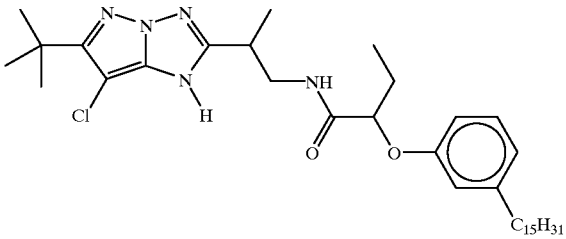

Couplers that form yellow dyes upon reaction with oxidized color developing agent are described in such representative patents and publications as: U.S. Pat. Nos. 2,298, 443; 2,407,210; 2,875,057; 3,048,194; 3,265,506; 3,447, 928; 3,960,570; 4,022,620; 4,443,536; 4,910,126; and 5,340,703 and "Farbkuppler-eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803. For improved color reproduction, couplers which give yellow dyes that cut off sharply on the long wavelength side are particularly preferred (for example, see U.S. Pat. No. 5,360,713).

Typical preferred yellow couplers are represented by the following formulas:

YELLOW-1

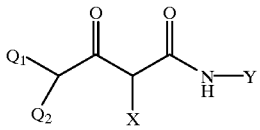

YELLOW-2

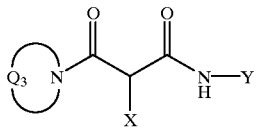

YELLOW-3

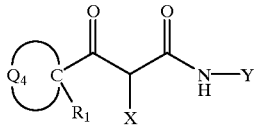

YELLOW-4

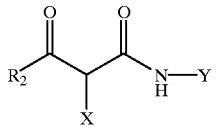

wherein $R_1$, $R_2$, $Q_1$ and $Q_2$ each represents a substituent; X is hydrogen or a coupling-off group; Y represents an aryl group or a heterocyclic group; $Q_3$ represents an organic residue required to form a nitrogen-containing heterocyclic group together with the >N—; and $Q_4$ represents nonmetallic atoms necessary to from a 3- to 5-membered hydrocarbon ring or a 3- to 5-membered heterocyclic ring which contains at least one hetero atom selected from N, O, S, and P in the ring. Particularly preferred is when $Q_1$ and $Q_2$ each represents an alkyl group, an aryl group, or a heterocyclic group, and $R_2$ represents an aryl or tertiary alkyl group.

Preferred yellow couplers can be of the following general structures:

Y-1

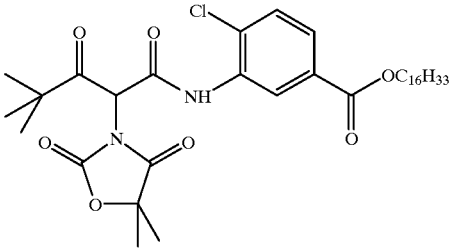

-continued

Y-2

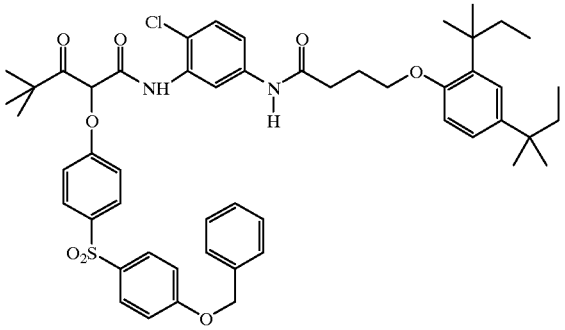

Y-3

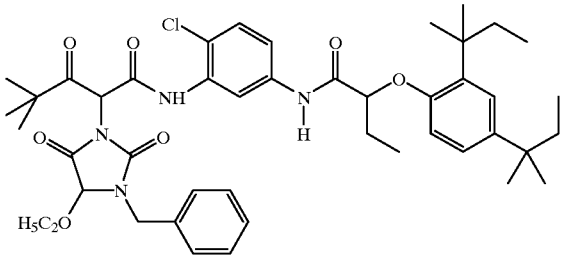

Y-4

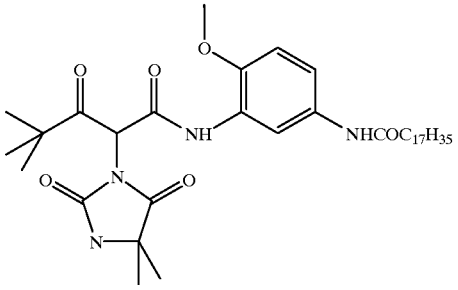

Y-5

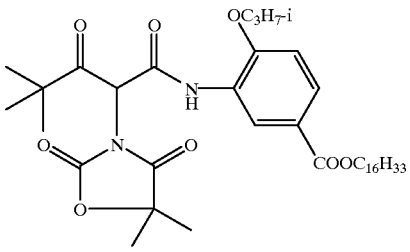

Y-6

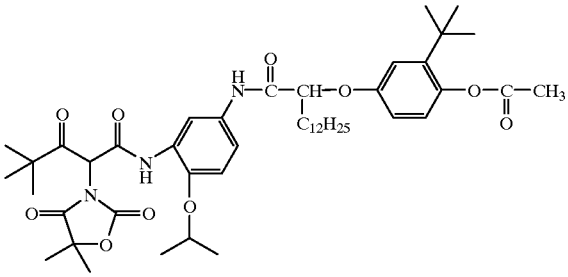

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as vinyl, 2-butenyl; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5 -tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl, methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amino, such as phenylanilino, 2-chloroanilino, diethylamino, dodecylamino; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3- to 7-membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

Representative substituents on ballast groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

Stabilizers and scavengers that can be used in these photographic elements, but are not limited to, the following:

ST-1

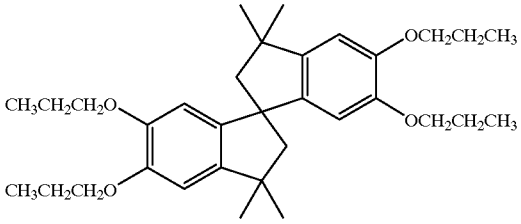

ST-2

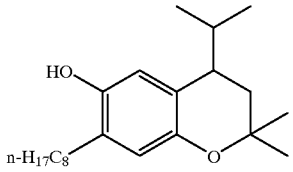

-continued

ST-3

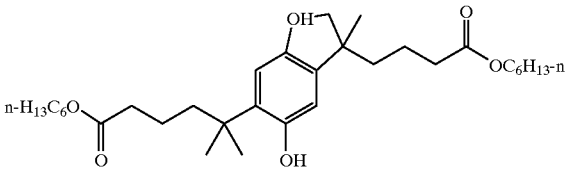

ST-4

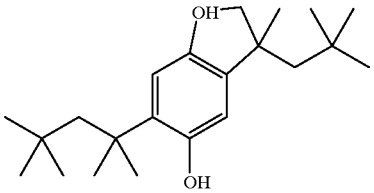

ST-5

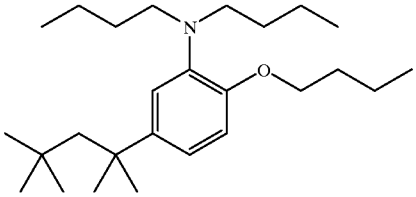

ST-6

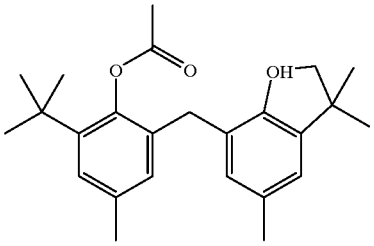

ST-7

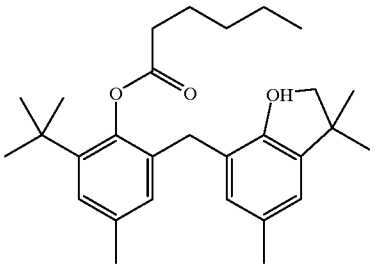

ST-8

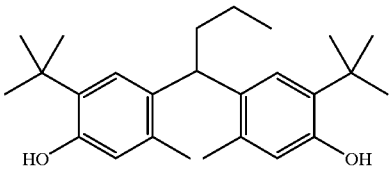

ST-9

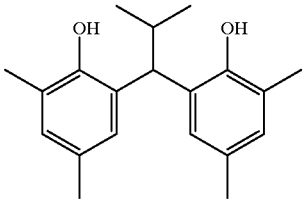

-continued
ST-10
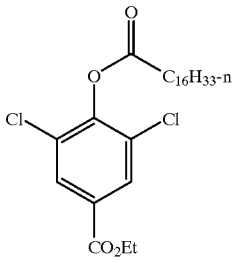
ST-11
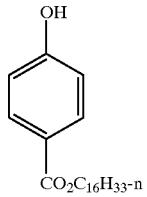
ST-12
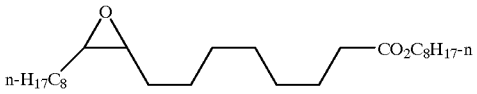
ST-13
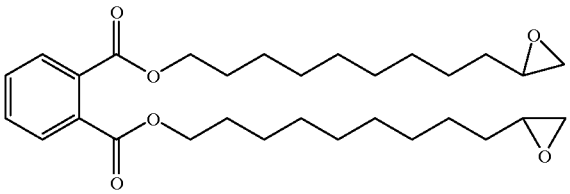
ST-14
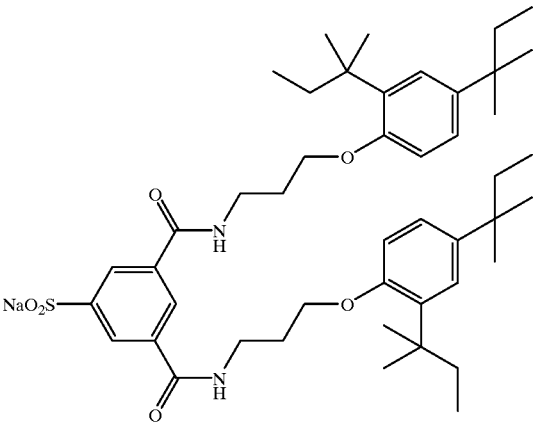
ST-15
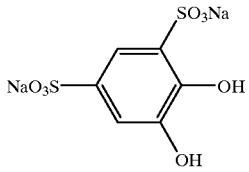
-continued
ST-16
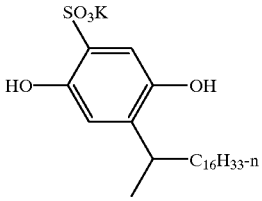
ST-17
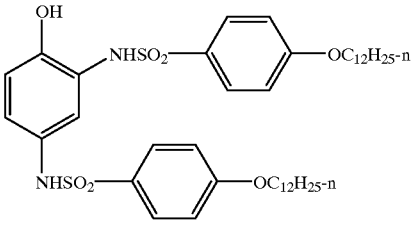
ST-18
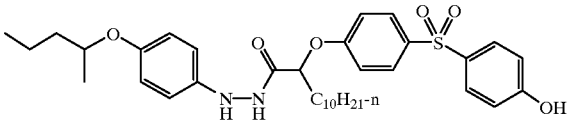
ST-19
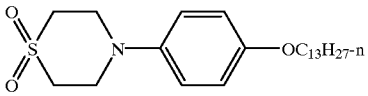
ST-20
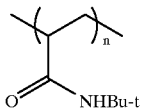
n = 75–8,000
ST-21
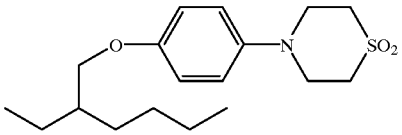
ST-22
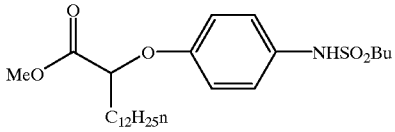
ST-23
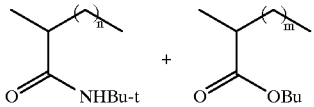
ST-24
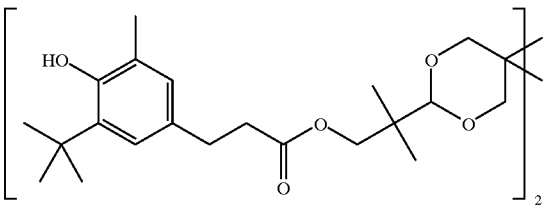

n:m 1:1 mw=75–100,000

Examples of solvents which may be used in the invention include the following:

Tritolyl phosphate S-1
Dibutyl phthalate S-2
Diundecyl phthalate S-3
N,N-Diethyldodecanamide S-4
N,N-Dibutyldodecanamide S-5
Tris(2-ethylhexyl)phosphate S-6
Acetyl tributyl citrate S-7
2,4-Di-tert-pentylphenol S-8
2-(2-Butoxyethoxy)ethyl acetate S-9
1,4-Cyclohexyldimethylene bis(2-ethylhexanoate) S-10

The dispersions used in photographic elements may also include ultraviolet (UV) stabilizers and so-called liquid UV stabilizers such as described in U.S. Pat. Nos. 4,992,358; 4,975,360; and 4,587,346. Examples of UV stabilizers are shown below.

UV-1

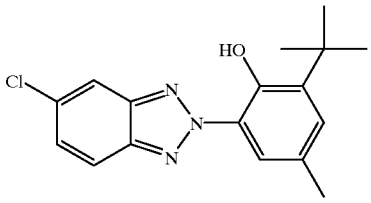

UV-2

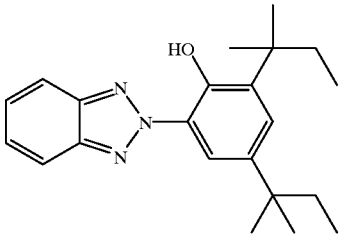

UV-3

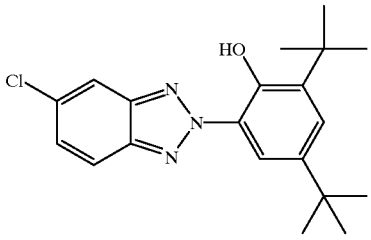

UV-4

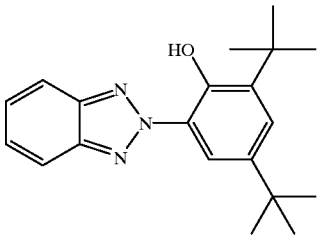

-continued

UV-5

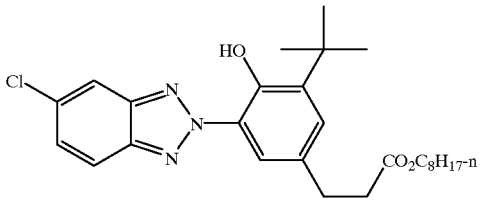

UV-6

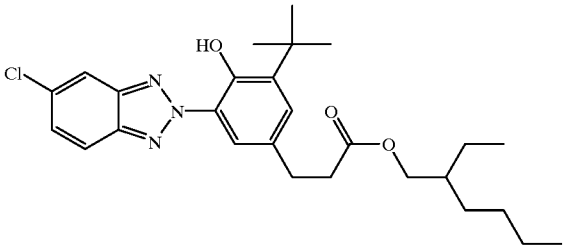

UV-7

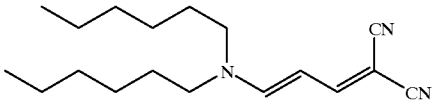

UV-8

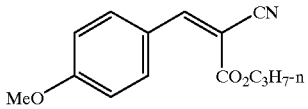

The aqueous phase may include surfactants. Surfactant may be cationic, anionic, zwitterionic or non-ionic. Useful surfactants include, but are not limited to, the following:

SF-1

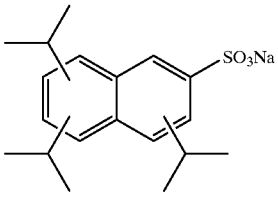

SF-2

$CF_3{\bullet}(CF_2)_7{\bullet}SO_3Na$

SF-3

$CF_3{\bullet}(CH_2)_n{\bullet}SO_3Na$, n = 12–14

SF-4

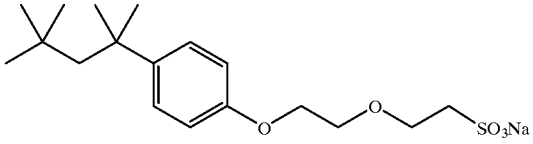

SF-5

$CH_3{\bullet}(CH_2)_{11}{\bullet}OSO_3Na$

-continued

SF-6

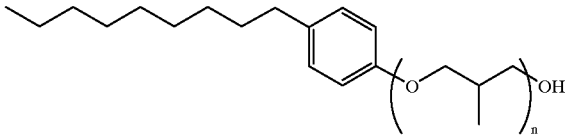

n = ca. 10

SF-7

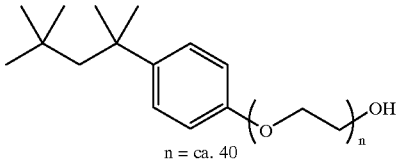

n = ca. 40

SF-8

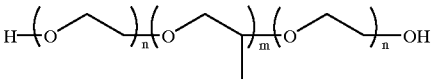

n = ca. 6, m = ca. 2

SF-9

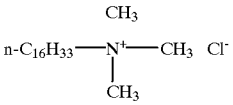

SF-10

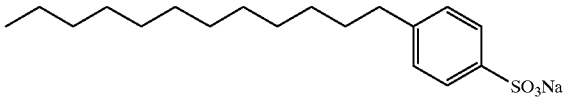

SF-11

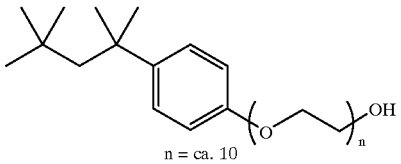

n = ca. 10

SF-12

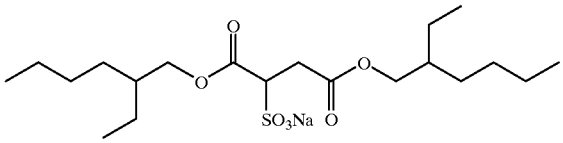

Further, it is contemplated to stabilize photographic dispersions prone to particle growth through the use of hydrophobic, photographically inert compounds such as disclosed by Zengerle et al U.S. Pat. No. 5,468,604.

In a preferred embodiment the invention employs recording elements which are constructed to contain at least three silver halide emulsion and preferably six layer units. A suitable full color, multilayer format for a recording element used in the invention is represented by Structure I.

| STRUCTURE I |
|---|
| Red-sensitized cyan dye image-forming silver halide emulsion unit |
| Interlayer |
| Green-sensitized magenta dye image-forming silver halide emulsion unit |
| Interlayer |
| Blue-sensitized yellow dye image-forming silver halide emulsion unit |
| ///// Support ///// |

-continued

| STRUCTURE I |
|---|
| Blue-sensitized yellow dye image-forming silver halide emulsion unit |
| Interlayer |
| Green-sensitized magenta dye image-forming silver halide emulsion unit |
| Interlayer |
| Red-sensitized cyan dye image-forming silver halide emulsion unit |

The image-forming units are separated from each other by hydrophilic colloid interlayers containing an oxidized developing agent scavenger to prevent color contamination. Silver halide emulsions satisfying the grain and gelatino-peptizer requirements described above can be present in any one or combination of the emulsion layer units. Additional useful multicolor, multilayer formats for an element of the invention include structures as described in U.S. Pat. No. 5,783,373. Each of such structures in accordance with the invention preferably would contain six silver halide emulsions comprised of high chloride grains having at least 50 percent of their surface area bounded by {100} crystal faces and containing dopants from classes (i) and (ii), as described above. Preferably each of the emulsion layer units contains emulsion satisfying these criteria.

Conventional features that can be incorporated into multilayer (and particularly multicolor) recording elements contemplated for use in the method of the invention are illustrated by *Research Disclosure,* Item 38957, cited above:

XI. Layers and layer arrangements

XII. Features applicable only to color negative

XIII. Features applicable only to color positive

B. Color reversal

C. Color positives derived from color negatives

XIV. Scan facilitating features.

The recording elements comprising the radiation sensitive high chloride emulsion layers according to this invention can be conventionally optically printed, or in accordance with a particular embodiment of the invention can be image-wise exposed in a pixel-by-pixel mode using suitable high energy radiation sources typically employed in electronic printing methods. Suitable actinic forms of energy encompass the ultraviolet, visible, and infrared regions of the electromagnetic spectrum, as well as electron-beam radiation and is conveniently supplied by beams from one or more light emitting diodes or lasers, including gaseous or solid state lasers. Exposures can be monochromatic, orthochromatic, or panchromatic. For example, when the recording element is a multilayer multicolor element, exposure can be provided by laser or light emitting diode beams of appropriate spectral radiation, for example, infrared, red, green or blue wavelengths, to which such element is sensitive. Multicolor elements can be employed which produce cyan, magenta and yellow dyes as a function of exposure in separate portions of the electromagnetic spectrum, including at least two portions of the infrared region, as disclosed in the previously mentioned U.S. Pat. No. 4,619,892. Suitable exposures include those up to 2000 nm, preferably up to 1500 nm. Suitable light emitting diodes and commercially available laser sources are known and commercially available. Imagewise exposures at ambient, elevated, or reduced temperatures and/or pressures can be employed within the useful response range of the recording element determined by conventional sensitometric techniques, as illustrated by T. H. James, *The Theory of the Photographic Process,* 4th Ed., Macmillan, 1977, Chapters 4, 6, 17, 18, and 23.

It has been observed that anionic $[MX_xY_yL_z]$ hexacoordination complexes, where M is a group 8 or 9 metal (preferably iron, ruthenium or iridium), X is halide or pseudohalide (preferably Cl, Br, or CN) x is 3 to 5, Y is $H_2O$, y is 0 or 1, L is a C—C, H—C or C—N—H organic ligand, and Z is 1 or 2, are surprisingly effective in reducing high intensity reciprocity failure (HIRF), low intensity reciprocity failure (LIRF) and thermal sensitivity variance and in an improving latent image keeping (LIK). As herein employed, HIRF is a measure of the variance of photographic properties for equal exposures, but with exposure times ranging from $10^{-1}$ to $10^{-6}$ second. LIRF is a measure of the variance of photographic properties for equal exposures, but with exposure times ranging from $10^{-1}$ to 100 seconds. Although these advantages can be generally compatible with face centered cubic lattice grain structures, the most striking improvements have been observed in high (>50 mole %, preferably ≧90 mole %) chloride emulsions. Preferred C—C, H—C, or C—N—H organic ligands are aromatic heterocycles of the type described in U.S. Pat. No. 5,462,849. The most effective C—C, H—C, or C—N—H organic ligands are azoles and azines, either unsubstituted or containing alkyl, alkoxy, or halide substituents, where the alkyl moieties contain from 1 to 8 carbon atoms. Particularly preferred azoles and azines include thiazoles, thiazolines, and pyrazines.

The quantity or level of high energy actinic radiation provided to the recording medium by the exposure source is generally at least $10^{-4}$ ergs/cm$^2$, typically in the range of about $10^{-4}$ ergs/cm$^2$ to $10^{-3}$ ergs/cm$^2$ and often from $10^{-3}$ ergs/cm$^2$ to $10^2$ ergs/cm$^2$. Exposure of the recording element in a pixel-by-pixel mode as known in the prior art persists for only a very short duration or time. Typical maximum exposure times are up to 100$\mu$ seconds, often up to 10$\mu$ seconds, and frequently up to only 0.5$\mu$ seconds. Single or multiple exposures of each pixel are contemplated. The pixel density is subject to wide variation, as is obvious to those skilled in the art. The higher the pixel density, the sharper the images can be, but at the expense of equipment complexity. In general, pixel densities used in conventional electronic printing methods of the type described herein do not exceed $10^7$ pixels/cm$^2$ and are typically in the range of about $10^4$ to $10^6$ pixels/cm$^2$. An assessment of the technology of high-quality, continuous-tone, color electronic printing using silver halide photographic paper which discusses various features and components of the system, including exposure source, exposure time, exposure level and pixel density and other recording element characteristics is provided in Firth et al., *A Continuous-Tone Laser Color Printer,* Journal of Imaging Technology, Vol. 14, No. 3, June 1988. As previously indicated herein, a description of some of the details of conventional electronic printing methods comprising scanning a recording element with high energy beams such as light emitting diodes or laser beams, is set forth in Hioki U.S. Patent 5,126,235 and European Patent Applications 479 167 A1 and 502 508 A1.

Once imagewise exposed, the recording elements can be processed in any convenient conventional manner to obtain a viewable image. Such processing is illustrated by *Research Disclosure,* Item 38957, cited above:

XVIII. Chemical development systems

XIX. Development

XX. Desilvering, washing, rinsing, and stabilizing

In addition, a useful developer for the inventive material is a homogeneous, single-part developing agent. The homogeneous, single-part color developing concentrate is prepared using a critical sequence of steps:

In the first step, an aqueous solution of a suitable color developing agent is prepared. This color developing agent is generally in the form of a sulfate salt. Other components of the solution can include an antioxidant for the color developing agent, a suitable number of alkali metal ions (in an at least stoichiometric proportion to the sulfate ions) provided by an alkali metal base, and a photographically inactive water-miscible or water-soluble hydroxy-containing organic solvent. This solvent is present in the final concentrate at a concentration such that the weight ratio of water to the organic solvent is from about 15:85 to about 50:50.

In this environment, especially at high alkalinity, alkali metal ions and sulfate ions form a sulfate salt that is precipitated in the presence of the hydroxy-containing organic solvent. The precipitated sulfate salt can then be readily removed using any suitable liquid/solid phase separation technique (including filtration, centrifugation, or decantation). If the antioxidant is a liquid organic compound, two phases may be formed and the precipitate may be removed by discarding the aqueous phase.

The color developing concentrates of this invention include one or more color developing agents that are well known in the art that, in oxidized form, will react with dye forming color couplers in the processed materials. Such color developing agents include, but are not limited to, aminophenols, p-phenylenediamines (especially N,N-dialkyl-p-phenylenediamines) and others which are well known in the art, such as EP 0 434 097 A1 (published Jun. 26, 1991) and EP 0 530 921 A1 (published Mar. 10, 1993). It may be useful for the color developing agents to have one or more water-solubilizing groups as are known in the art. Further details of such materials are provided in *Research Disclosure,* 38957, pages 592–639 (September 1996). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*".

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-σ-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, and others readily apparent to one skilled in the art.

In order to protect the color developing agents from oxidation, one or more antioxidants are generally included in the color developing compositions. Either inorganic or organic antioxidants can be used. Many classes of useful antioxidants are known, including but not limited to, sulfites (such as sodium sulfite, potassium sulfite, sodium bisulfite and potassium metabisulfite), hydroxylamine (and derivatives thereof), hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, and oximes. Also useful as antioxidants are 1,4-cyclohexadiones. Mixtures of compounds from the same or different classes of antioxidants can also be used if desired.

Especially useful antioxidants are hydroxylamine derivatives as described, for example, in U.S. Pat. Nos. 4,892,804; 4,876,174; 5,354,646; and 5,660,974, all noted above, and U.S. Pat. No. 5,646,327 (Burns et al). Many of these antioxidants are mono- and dialkylhydroxylamines having one or more substituents on one or both alkyl groups. Particularly useful alkyl substituents include sulfo, carboxy, amino, sulfonamido, carbonamido, hydroxy, and other solubilizing substituents.

More preferably, the noted hydroxylamine derivatives can be mono- or dialkylhydroxylamines having one or more hydroxy substituents on the one or more alkyl groups. Representative compounds of this type are described, for example, in U.S. Pat. No. 5,709,982 (Marrese et al), as having the structure AI:

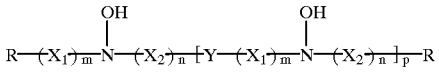

wherein

R is hydrogen, a substituted or unsubstituted alkyl group of 1 to 10 carbon atoms, a substituted or unsubstituted hydroxyalkyl group of 1 to 10 carbon atoms, a substituted or unsubstituted cycloalkyl group of 5 to 10 carbon atoms, or a substituted or unsubstituted aryl group having 6 to 10 carbon atoms in the aromatic nucleus.

$X_1$ is —$CR_2(OH)CHR_1$— and $X_2$ is —$CHR_1CR_2(OH)$— wherein $R_1$ and $R_2$ are independently hydrogen, hydroxy, a substituted or unsubstituted alkyl group of 1 or 2 carbon atoms, a substituted or unsubstituted hydroxyalkyl group of 1 or 2 carbon atoms, or $R_1$ and $R_2$ together represent the carbon atoms necessary to complete a substituted or unsubstituted 5- to 8-membered saturated or unsaturated carbocyclic ring structure.

Y is a substituted or unsubstituted alkylene group having at least 4 carbon atoms, and has an even number of carbon atoms, or Y is a substituted or unsubstituted divalent aliphatic group having an even total number of carbon and oxygen atoms in the chain, provided that the aliphatic group has a least 4 atoms in the chain.

Also in Structure AI, m, n, and p are independently 0 or 1. Preferably, each of m and n is 1, and p is 0. Specific di-substituted hydroxylamine antioxidants include, but are not limited to, N,N-bis(2,3-dihydroxypropyl)-hydroxylamine, N,N-bis(2-methyl-2,3-dihydroxypropyl) hydroxylamine, and N,N-bis(1-hydroxymethyl-2-hydroxy-3-phenylpropyl)hydroxylamine. The first compound is preferred.

In the following Table, reference will be made to (1) *Research Disclosure,* December 1978, Item 17643, (2) *Research Disclosure,* December 1989, Item 308119, and (3) *Research Disclosure,* September 1994, Item 36544, all published by Kenneth Mason Publications, Ltd., Dudley Annex, 12a North Street, Emsworth, Hampshire PO10 7DQ, ENGLAND. The Table and the references cited in the Table are to be read as describing particular components suitable for use in the elements of the invention. The Table and its cited references also describe suitable ways of preparing, exposing, processing and manipulating the elements, and the images contained therein.

| Reference | Section | Subject Matter |
|---|---|---|
| 1 | I, II | Grain composition, morphology |
| 2 | I, II, IX, X, XI, | and preparation. Emulsion |
| 3 | XII, XIV, XV | preparation including hardeners, |
| | I, II, III, IX | coating aids, addenda, etc. |
| | A & B | |
| 1 | III, IV | Chemical sensitization and |
| 2 | III, IV | spectral sensitization/ |
| 3 | IV, V | Desensitization |
| 1 | V | UV dyes, optical brighteners, |
| 2 | V | luminescent dyes |
| 3 | VI | |
| 1 | VI | Antifoggants and stabilizers |
| 2 | VI | |
| 3 | VII | |
| 1 | VIII | Absorbing and scattering |
| 2 | VIII, XIII, XVI | materials; Antistatic layers; |
| 3 | VIII, IX C & D | matting agents |
| 1 | VII | Image-couplers and image- |
| 2 | VII | modifying couplers; Dye |
| 3 | X | stabilizers and hue modifiers |
| 1 | XVII | Supports |
| 2 | XVII | |
| 3 | XV | |
| 3 | XI | Specific layer arrangements |
| 3 | XII, XIII | Negative working emulsions; Direct positive emulsions |
| 2 | XVIII | Exposure |
| 3 | XVI | |
| 1 | XIX, XX | Chemical processing; |
| 2 | XIX, XX, XXII | Developing agents |
| 3 | XVIII, XIX, XX | |
| 3 | XIV | Scanning and digital processing procedures |

The photographic elements can be exposed with various forms of energy which encompass the ultraviolet, visible, and infrared regions of the electromagnetic spectrum, as well as with electron beam, beta radiation, gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic element.

The preferred reflective/transmission display materials of this invention wherein said imaging element comprises at least one dye forming layer comprising silver halide and dye forming coupler on the opposite side of said transparent polymer sheet from the oriented voided polyester and said exposure of both coupler containing layers is from the side of said imaging element having the oriented polyester layer is preferred. This allows for traditional image processing equipment to be used. The imaging elements of this invention can be exposed via traditional optical methods using a negative, but they are preferably exposed by means of a collimated beam, to form a latent image, and then processed to form a visible image, preferably by other than heat treatment. A collimated beam is preferred as it allows for digital printing and simultaneous exposure of the imaging layer on the top and bottom side without significant internal light scatter. A preferred example of a collimated beam is a laser also known as light amplification by stimulated emission of radiation. The laser is preferred because this technology is used widely in a number of digital printing equipment types. Further, the laser provides sufficient energy to simultaneously expose the light sensitive silver halide coating on the top and bottom side of the display material of this invention without undesirable light scatter. Subsequent processing of the latent image into a visible image is preferably carried out in the known RA-4™ (Eastman Kodak Company) process or other processing systems suitable for developing high chloride emulsions.

The following examples illustrate the practice of this invention. They are not intended to be exhaustive of all possible variations of the invention. Parts and percentages are by weight unless otherwise indicated.

EXAMPLES

Example 1

In this example the invention is compared to a typical prior art transmission display material, Kodak Duratrans™ that has a polyester terephthalate base with cyan, magenta, and yellow dye forming emulsion layers on one side. The invention is a duplitized silver halide emulsion coating support containing a microvoided polyester layer integrally attached to a transparent polyester base. The prior art material and the invention were measured for % transmission, lightness, color, and illuminant show through. This example will show a reduction in the yellowness of the base and a reduction in developer time compared to the prior art materials.

The following photographic transmission display material of the invention was prepared by coextrusion of a biaxially oriented polyester sheet containing a microvoided polyester skin layer on the top surface of said polyester sheet. The base core of this structure was a clear polyester that was subbed on the bottommost side with an adhesion promoting gelatin based material to enhance the adhesion of gelatin from the light sensitive emulsion to the imaging member. The same adhesion promoting material was subbed on the outer surface of said microvoided polyester skin layer. An optical brightener was added in layer L2 at 0.05% by weight of base polymer. The optical brightener used was Hostalux KS manufactured by Ciba-Geigy. Rutile $TiO_2$ was added to the L2 at 0.5% by weight of base polymer. The $TiO_2$ type was DuPont R104 (a 0.22 micrometer particle size $TiO_2$). Shepperd blue dye 125A was also added in layer L2 at 0.005% by weight of base polymer. The voids in layer L2 were formed via the addition of 5 $\mu$m cross-linked polystyrene beads at 15% by weight of base polymer, said beads forming voids during the biaxial orientation stretching process in making said base. Table 1 below lists the characteristics oriented polyester sheet used in this example.

TABLE 1

| | | |
|---|---|---|
| L1 | Gel Sub Layer | 0.762 |
| L2 | Voided Polyester W/$TiO_2$, OB, Blue dye | 20 |
| L3 | Polyester | 150 |
| L4 | Gel Sub Layer | 0.762 |

The display materials were processed without exposure to obtain a minimum density. The display support was measured for status A density using an X-Rite Model 310 photographic densitometer. Spectral transmission is calculated from the Status A density readings and is the ratio of the transmitted power to the incident power and is expressed as a percentage as follows; $T_{RGB}=10^{-D}*100$ where D is the average of the red, green, and blue Status A transmission density response. The display material were also measured for L*, a*, and b* using a Spectrogard spectrophotometer, CIE system, using illuminant D6500. In the transmission mode, a qualitative assessment was made as to the amount of illuminating backlighting show through. A substantial amount of lamp show through would be considered undesirable, as the back illuminating light sources could interfere with the image quality. The data for invention are listed in Table 4 below.

TABLE 4

| Measurement | Value |
|---|---|
| % Transmission | 55% |
| CIE D6500 L* | 74.00 |
| CIE D6500 a* | −0.05 |
| CIE D6500 b* | −2.15 |
| Illuminating Backlight Show through | None |

The reflection/transmission display support coated on the top and bottom sides with the light sensitive silver halide coating format of this invention example exhibits all the properties needed for an photographic display material that can function as both a reflective and transmission display material. Further, the invention photographic reflection/transmission display material of this example has many advantages over prior art photographic display materials. The voided layers have levels of $TiO_2$ and colorants adjusted to provide an improved minimum density position compared to prior art reflection display materials or prior art transmission display materials, as the invention was able to overcome the native yellowness of the processed emulsion layers (b* for the invention was −2.15 compared to a b* of 7.0 for the comparison prior art transmission material). In the transmission mode, the illuminating backlights did not show through indicating an acceptable transmission product.

The % transmission for the invention (55%) provides an acceptable reflection image and allows enough light through the support to be an acceptable transmission image. A display material that functions as both transmission materials and reflective materials has significant commercial value, as the quality of the display image is robust to lighting factors. Further, because the void size of the polyester sheet of the invention, the voided polyester sheet allows more transmission light through the duplitized image without allowing the illuminating light source to show through the image.

Contemplated coatings 2–1 to 2–6 were prepared as described in Table 5.

TABLE 5

| Variation<br>Comment | 2-1<br>Check | 2-2<br>Check | 2-3<br>Invention | 2-4<br>Invention | 2-5<br>Invention | 2-6<br>Invention |
|---|---|---|---|---|---|---|
| Front SOC | SOC-1 | SOC-1 | SOC-1 | SOC-1 | SOC-1 | SOC-1 |
| UV Layer | UV-1 | UV-1 | UV-1 | UV-1 | UV-1 | UV-1 |
| Red Layer | RL-1 | RL-1 | RL-2 | RL-2 | RL-2 | RL-2 |
| UV Interlayer | UV IL-1 | UV IL-1 | UV IL-1 | UV IL-1 | UV IL-1 | UV IL-1 |
| Green Layer | GL-1 | GL-1 | GL-2 | GL-2 | GL-2 | GL-2 |

TABLE 5-continued

| Variation<br>Comment | 2-1<br>Check | 2-2<br>Check | 2-3<br>Invention | 2-4<br>Invention | 2-5<br>Invention | 2-6<br>Invention |
|---|---|---|---|---|---|---|
| Interlayer | IL-1 | IL-1 | IL-1 | IL-1 | IL-1 | IL-1 |
| Yellow Layer | SY-1 | SY-1 | SY-1 | SY-1 | SY-1 | None |
| Blue Layer | BL-1 | BL-1 | BL-2 | BL-2 | BL-2 | BL-3 |
| Support | S-1 | S-1 | S-1 | S-1 | S-1 | S-1 |
| Blue Layer | BL-1 | BL-1 | BL-2 | BL-2 | BL-2 | BL-3 |
| Yellow Layer | SY-1 | SY-1 | SY-1 | SY-1 | SY-1 | None |
| Interlayer | IL-1 | IL-1 | IL-1 | IL-1 | IL-1 | IL-1 |
| Green Layer | GL-1 | GL-1 | GL-2 | GL-2 | GL-2 | GL-2 |
| UV Interlayer | UV IL-1 | UV IL-1 | UV IL-1 | UV IL-1 | UV IL-1 | UV IL-1 |
| Red Layer | RL-1 | RL-1 | RL-2 | RL-2 | RL-2 | RL-2 |
| Tone Enhancing Layer | UV-1 | UV-1 | UV-1 | TEL-1 | TEL-2 | TEL-2 |
| Back SOC | SOC-2 | SOC-3 | SOC-4 | SOC-5 | SOC-5 | SOC-5 |

The following layer formulations are prepared by methods well known to the art. All material lay downs are expressed in terms of g/m$^2$.

| | |
|---|---|
| BL-1: Blue Sensitive Layer | |
| Gelatin | 1.184 |
| Blue Sensitive Silver | 0.280 |
| Y-1 | 0.452 |
| ST-1 | 0.078 |
| ST-2 | 0.026 |
| Diundecyl phthalate | 0.198 |
| BL-2: Blue Sensitive Layer | |
| Gelatin | 1.306 |
| Blue Sensitive Silver | 0.350 |
| Y-1 | 0.452 |
| ST-1 | 0.078 |
| ST-2 | 0.026 |
| Diundecyl phthalate | 0.198 |
| BL-3: Blue Sensitive Layer | |
| Gelatin | 1.629 |
| Blue Sensitive Silver | 0.322 |
| Y-2 | 0.484 |
| ST-3 | 0.255 |
| Tributyl citrate | 0.141 |
| Poly(N-tert-butylacrylamide) | 0.484 |
| SY-1: Enhancer Layer | |
| Gelatin | 0.323 |
| Y-1 | 0.194 |
| ST-1 | 0.033 |
| ST-2 | 0.011 |
| Diundecyl phthalate | 0.085 |
| IL-1: Interlayer | |
| Gelatin | 0.753 |
| 2,5-Di-tert-octyl hydroquinone | 0.066 |
| Dibutyl phthalate | 0.188 |
| Disodium 4,5 Dihydroxy-m-benzenedisulfonate | 0.065 |
| Irganox 1076 ™ | 0.010 |
| GL-1: Green Sensitive Layer | |
| Gelatin | 1.340 |
| Green Sensitive Silver | 0.104 |
| M-1 | 0.225 |
| Dibutyl phthalate | 0.080 |
| ST-4 | 0.061 |
| ST-5 | 0.171 |
| ST-6 | 0.571 |
| GL-2: Green Sensitive Layer | |
| Gelatin | 1.340 |
| Green Sensitive Silver | 0.130 |
| M-1 | 0.225 |
| Dibutyl phthalate | 0.080 |

-continued

| | |
|---|---|
| ST-4 | 0.061 |
| ST-5 | 0.171 |
| ST-6 | 0.571 |
| UV IL-1: UV Interlayer | |
| Gelatin | 0.712 |
| UV-1 | 0.030 |
| UV-2 | 0.172 |
| 2,5-Di-tert-octyl hydroquinone | 0.055 |
| Dibutyl phthalate | 0.034 |
| 1,4-Cyclohexylenedimethylene bis(2-ethylhexanoate) | 0.034 |
| RL-1 Red Sensitive Layer | |
| Gelatin | 1.338 |
| Red Sensitive Silver | 0.211 |
| C-1 | 0.381 |
| Dibutyl phthalate | 0.373 |
| UV-2 | 0.246 |
| 2-(2-butoxyethoxy)ethyl acetate | 0.031 |
| 2,5-Di-tert-octyl hydroquinone | 0.003 |
| Potassium tolylthiosulfonate | 0.003 |
| Potassium tolylsulfinate | 0.0003 |
| RL-2 Red Sensitive Layer | |
| Gelatin | 1.338 |
| Red Sensitive Silver | 0.264 |
| C-1 | 0.381 |
| Dibutyl phthalate | 0.373 |
| UV-2 | 0.246 |
| 2-(2-butoxyethoxy)ethyl acetate | 0.031 |
| 2,5-Di-tert-octyl hydroquinone | 0.003 |
| Potassium tolylthiosulfonate | 0.003 |
| Potassium tolylsulfinate | 0.0003 |
| UV-1: UV Overcoat | |
| Gelatin | 0.537 |
| UV-1 | 0.023 |
| UV-2 | 0.130 |
| 2,5-Di-tert-octyl hydroquinone | 0.042 |
| Dibutyl phthalate | 0.025 |
| 1,4-Cyclohexylenedimethylene bis(2-ethylhexanoate) | 0.025 |
| TEL-1: Tone Enhancing Layer | |
| Gelatin | 0.537 |
| UV-1 | 0.023 |
| UV-2 | 0.130 |
| 2,5-Di-tert-octyl hydroquinone | 0.042 |
| Titanium Dioxide | 0.269 |
| Dibutyl phthalate | 0.025 |
| 1,4-Cyclohexylenedimethylene bis(2-ethylhexanoate) | 0.025 |
| TEL-2: Tone Enhancing Layer | |
| Gelatin | 0.537 |
| UV-1 | 0.023 |
| UV-2 | 0.130 |
| 2,5-Di-tert-octyl hydroquinone | 0.042 |
| Titanium Dioxide | 0.538 |

-continued

| | |
|---|---|
| Dibutyl phthalate | 0.025 |
| 1,4-Cyclohexylenedimethylene bis(2-ethylhexanoate) | 0.025 |
| TEL-3: Tone Enhancing Layer | |
| Gelatin | 0.537 |
| 2,5-Di-tert-octyl hydroquinone | 0.042 |
| Titanium Dioxide | 0.538 |
| Dibutyl phthalate | 0.120 |
| Irganox 1076 ™ | 0.006 |
| SOC-1: SOC | |
| Gelatin | 1.076 |
| 2,5-Di-tert-octyl hydroquinone | 0.013 |
| Dibutyl phthalate | 0.039 |
| SF-1 | 0.009 |
| SF-2 | 0.004 |
| Polystyrene Matte Beads (2.5 μm average diameter) | 0.013 |
| Dye-1 | 0.011 |
| Dye-2 | 0.004 |
| Dye-3 | 0.009 |
| SOC-2: SOC | |
| Gelatin | 1.076 |
| 2,5-Di-tert-octyl hydroquinone | 0.013 |
| Dibutyl phthalate | 0.039 |
| SF-1 | 0.009 |
| SF-2 | 0.004 |
| Polystyrene Matte Beads (2.5 μm average diameter) | 0.125 |
| SOC-3: SOC | |
| Gelatin | 1.076 |
| 2,5-Di-tert-octyl hydroquinone | 0.013 |
| Dibutyl phthalate | 0.039 |
| SF-1 | 0.009 |
| SF-2 | 0.004 |
| Polystyrene Matte Beads (2.5 μm average diameter) | 0.125 |
| Dye-4 | 0.054 |
| Dye-5 | 0.108 |
| SOC-4: SOC | |
| Gelatin | 1.076 |
| 2,5-Di-tert-octyl hydroquinone | 0.013 |
| Dibutyl phthalate | 0.039 |
| SF-1 | 0.009 |
| SF-2 | 0.004 |
| Polystyrene Matte Beads (2.5 μm average diameter) | 0.125 |
| Titanium Dioxide | 1.076 |
| SOC-5: SOC | |
| Gelatin | 1.076 |
| 2,5-Di-tert-octyl hydroquinone | 0.013 |
| Dibutyl phthalate | 0.039 |
| SF-1 | 0.009 |
| SF-2 | 0.004 |
| Polystyrene Matte Beads (2.5 μm average diameter) | 0.125 |
| Dye-4 | 0.054 |
| Dye-5 | 0.108 |

STRUCTURES

Y-1

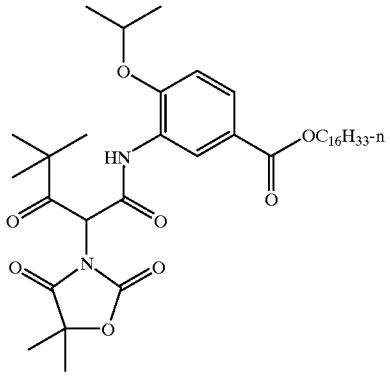

Y-2

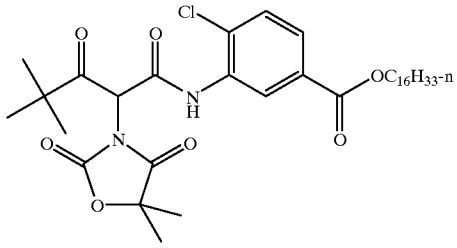

M-1

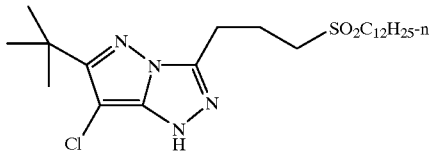

C-1

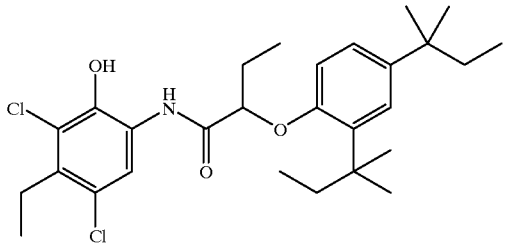

ST-1

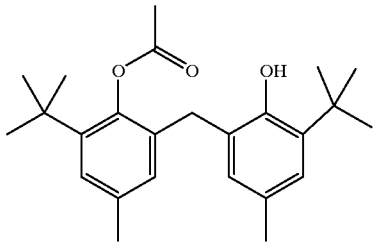

-continued

ST-2

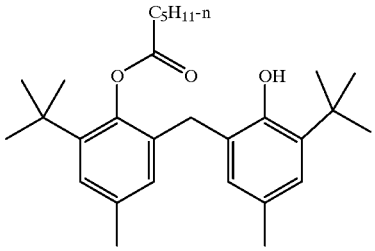

ST-3

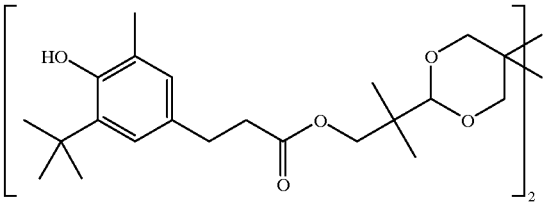

ST-4

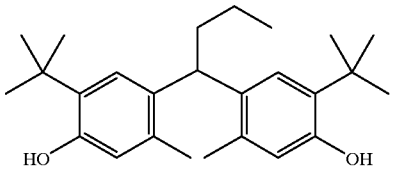

ST-5

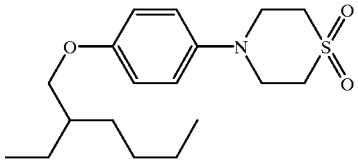

ST-6

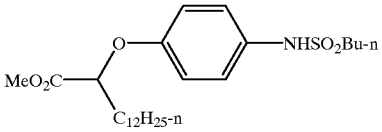

DYE-1

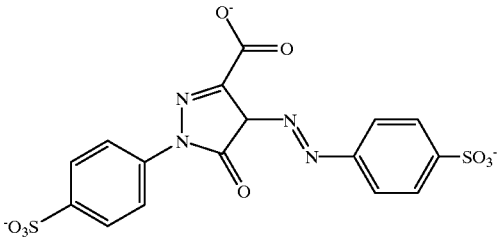

DYE-2

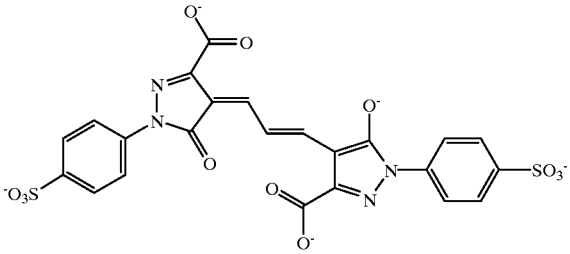

-continued

DYE-3

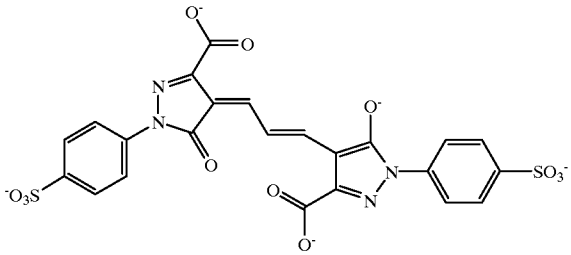

UV-1

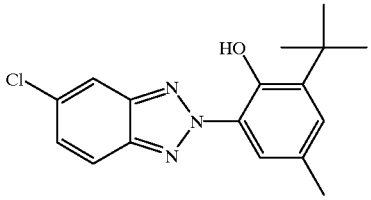

UV-2

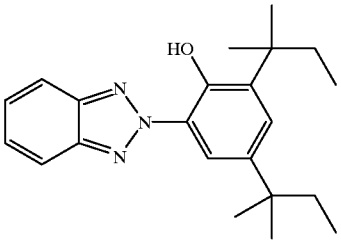

SF-1

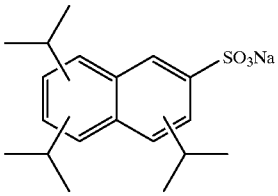

SF-2

$CF_3 \cdot (CF_2)_7 \cdot SO_3Na$

Prior art coating structure 2-1 has been shown to be inadequate because of uneven density obtained when exposed in devices that have uncontrolled backscatter, such as due to a shiny platen behind the photographic media. When an antihalation layer is added to the structure, the upper scale density can be profoundly reduced (see 2-2). The addition of the invention tone enhancing layer alone results in higher upper scale density (see 2-3) which provides much improved transmission image quality. The use of the tone enhancing layer in combination with the antihalation layer provides a means to recover upper scale density and provides robustness during image printing regardless of potential backscatter found in the printer design or through wear.

The voided polyester base in combination allows more illumination of the front image without the backlight source showing through the duplitized support compared to a voided polyolefin support. The voided polyester support also allows more exposure light energy to expose the backside image compared to a voided polyolefin sheet, thus allowing for more density to be developed on the backside image. More backside density creates a higher quality image in transmission. The voided polyester base tends to have a smaller void size than that of voided polyolefin because of the orientation ratio difference between voided polyester (typically 9×) and voided polyolefin (40×). Further, the void shape for polyester base given a typical orientation of 9× tends to be spherical compared to a planar void shape for oriented polyolefin. The spherical void shape of the voided polyester base avoids unwanted reflections that are nacreous in appearance when compared to polyolefin voided base materials.

Finally, because of the duplitized light sensitive silver halide coating, the invention had a developer time of 45 seconds compared to a developer time of 110 seconds for prior art transmission display materials, as prior art materials used heavy coverage on just the topside. A 45 second developer time has significant commercial value in that the display material of this invention can increase the productivity of expensive processing equipment.

What is claimed is:

1. A display material comprising a base, said base comprising a polyester sheet comprising at least one voided polyester diffusion layer, at least one topside photosensitive silver halide layer on the topside of said base and at least one bottom side photosensitive layer on the bottom side of said base, below said at least one bottom side emulsion layer a tone enhancing layer, and below said tone enhancing layer an antihalation layer, wherein said display material has a light transmission of between 35 and 60 percent in the developed Dmin areas of the display material.

2. The display material of claim 1 wherein said base further comprises a non-integral polymer sheet adhesively attached to said polyester sheet.

3. The display material of claim 1 wherein said polyester sheet is oriented in at least one direction.

4. The display material of claim 1 wherein said light transmission is between 38 and 55 percent.

5. The display material of claim 1 further comprising a layer containing white pigment above said voided diffusion layer.

6. The display material of claim 5 wherein said white pigment comprises between 2 and 8 percent by weight of said layer containing white pigment.

7. The display material of claim 1 further comprising a layer containing optical brightener or blue pigment above said voided layer.

8. The display material of claim 1 further comprising at least one layer comprising fluorocarbons above said voided layer.

9. The display material of claim 1 wherein said display material has a stiffness of between 100 and 400 millinewtons.

10. The display material of claim 1 wherein said diffusion layer comprises void spaces between 2 and 60% by volume of said polyester sheet.

11. The display material of claim 3 wherein said polyester polymer sheet comprises at least one subbing layer.

12. The display material of claim 1 further comprising a layer of antistatic material below said base and above said bottom side emulsion.

13. The display material of claim 12 wherein said antistatic material comprises at least one material selected from the group consisting of tin oxide and vanadium pentoxide.

14. The display material of claim 1 wherein said tone enhancing layer comprises titanium dioxide dispersed in gelatin.

15. The display material of claim 1 wherein said tone enhancing layer comprises white pigment.

16. The display material of claim 1 wherein said tone enhancing layer comprises between 0.25 and 10 g/m$^2$ of titanium dioxide.

17. The display material of claim 1 wherein below said tone enhancing layer and in said antihalation layer there are matte beads and charge control agent.

18. The display material of claim 1 wherein said antihalation layer has a density of between 0.2 and 1.2.

19. The display material of claim 1 wherein said antihalation layer comprises gray silver or solid particle dye dispersion.

20. The display material of claim 1 wherein said topside silver halide layer and said bottom side silver halide layer have substantially the same composition.

21. The display material of claim 1 wherein above said topside silver halide layer there is a layer comprising matte beads and charge control agent.

22. The display material of claim 1 wherein said material after exposure and development has a continuously increasing transmission D vs. log H curve between the toe and the shoulder regions.

23. The display material of claim 1 wherein said tone enhancing layer comprises between 0.75 and 5 g/m$^2$ of titanium dioxide.

24. The display material of claim 1 wherein said tone enhancing layer comprises between 1.0 and 2.55 g/m$^2$ of titanium dioxide.

25. A method of imaging comprising providing a display material comprising a base said base comprising a polyester sheet comprising at least one voided polyester diffusion layer, at least one topside photosensitive silver halide layer on the topside of said base and at least one bottom side photosensitive layer on the bottom side of said base, below said at least one bottom side emulsion layer a tone enhancing layer and below said tone enhancing layer an antihalation layer wherein said display material has a light transmission of between 35 and 60 percent in the developed Dmin areas of the display material, imagewise exposing said display material from the topside, developing the exposed display material, and recovering a display element.

26. The method of claim 25 wherein said base further comprises a non-integral polymer sheet adhesively attached to said polyester sheet.

27. The method of claim 26 wherein said polyester sheet is oriented in at least one direction.

28. The method of claim 25 wherein said light transmission is between 38 and 55 percent.

29. The method of claim 25 further comprising a layer containing white pigment above said voided diffusion layer.

30. The method of claim 25 wherein said display material has a stiffness of between 100 and 400 millinewtons.

31. The method of claim 26 wherein said polyester polymer sheet contains two or more coextruded layers.

32. The method of claim 25 wherein said tone enhancing layer comprises titanium dioxide dispersed in gelatin in an amount of between 1.0 and 2.5 g/m$^2$.

33. The method of claim 25 wherein said tone enhancing layer comprises white pigment.

34. The method of claim 25 wherein said tone enhancing layer comprises between 0.75 and 5 mg/m$^2$ of titanium dioxide.

35. The method of claim 25 wherein below said tone enhancing layer and in said antihalation layer there are matte beads and charge control agent.

36. A display material comprising a base, said base comprising a polyester sheet comprising at least one voided polyester diffusion layer, at least one topside photosensitive silver halide layer on the topside of said base and at least one bottom side photosensitive layer on the bottom side of said base, below said bottom side emulsion a tone enhancing layer, wherein said display material has a light transmission of between 35 and 60 percent in the developed Dmin areas of the display material.

37. The display material of claim 36 wherein said base further comprises a non-integral polymer sheet adhesively attached to said voided polyolefin sheet.

38. The display material of claim 37 wherein said non-integral sheet comprises polyester polymer.

39. The display material of claim 36 wherein said light transmission is between 38 and 55 percent.

40. The display material of claim 36 further comprising a layer containing optical brightener or blue pigment above said voided layer.

41. The display material of claim 36 wherein said tone enhancing layer comprises titanium dioxide dispersed in gelatin.

42. The display material of claim 36 wherein said tone enhancing layer comprises white pigment.

43. The display material of claim 36 wherein said tone enhancing layer comprises between 0.25 and 10 $g/m^2$ of titanium dioxide.

44. The display material of claim 36 wherein below said tone enhancing layer there are matte beads and charge control agent.

45. The display material of claim 36 wherein above said topside silver halide layer there is a layer comprising matte beads and charge control agent.

46. The display material of claim 36 wherein said material after exposure and development has a continuously increasing transmission D vs. log H curve between the toe and the shoulder regions.

* * * * *